United States Patent [19]

Kobayashi et al.

[11] Patent Number: 4,476,828

[45] Date of Patent: Oct. 16, 1984

[54] METHOD AND APPARATUS FOR CONTROLLING THE IDLING SPEED OF AN ENGINE

[75] Inventors: Nobuyuki Kobayashi, Toyota; Hiroshi Ito, Nagoya, both of Japan

[73] Assignee: Toyota Jidosha Kogyo Kabushiki Kaisha, Toyota, Japan

[21] Appl. No.: 287,119

[22] Filed: Jul. 27, 1981

[30] Foreign Application Priority Data

Jan. 23, 1981 [JP] Japan ..... 56-8141

[51] Int. Cl.[3] ..... F02D 11/10

[52] U.S. Cl. ..... 123/339; 123/340; 123/585

[58] Field of Search ..... 123/339, 179 L, 585, 123/586, 588, 589, 340

[56] References Cited

U.S. PATENT DOCUMENTS 3,960,130 6/1976 Peterson ..... 123/588

3,964,457 6/1976 Coscia ..... 123/339

4,237,833 12/1980 Des Lauriers ..... 123/339

*Primary Examiner*—Ronald B. Cox

*Attorney, Agent, or Firm*—Cushman, Darby & Cushman

[57] ABSTRACT

An engine has a main intake passage having a throttle valve therein. A bypass passage is branched off from the main intake passage located upstream of the throttle valve and is connected to the main intake passage located downstream of the throttle valve. A flow control valve, actuated by a stepper motor, is arranged in the bypass passage. When the idling speed of the engine is increased beyond a predetermined upper limit of the engine speed, the stepper motor is rotated in a rotating direction wherein the flow area of the flow control valve is reduced. Contrary to this, when the idling speed of the engine is reduced below a predetermined lower limit of the engine speed, the stepper motor is rotated in a direction wherein the flow area of the flow control valve is increased.

14 Claims, 25 Drawing Figures

| |
|---|
| Fig. 10 A |
| Fig. 10 B |

61
82
ROM
81
RAM
80
MPU
CLOCK
86
85
84
OUTPUT PORT
83
INPUT PORT
96
90
LATCH
IV III II I
DRIVE CIRCUIT
COUNTER
A-D CONVERTER
A-D CONVERTER
87
88
89
76
TEMPERATURE SENSOR
75
COOL MAX. SWITCH
74
HOT MAX. SWITCH
73
AIR CONDITIONING SWITCH
67
LUBRICATING OIL PRESSURE REATIVE SWITCH
64
ENGINE SPEED SENSOR
65
THROTTLE SWITCH
66
NEUTRAL SWITCH

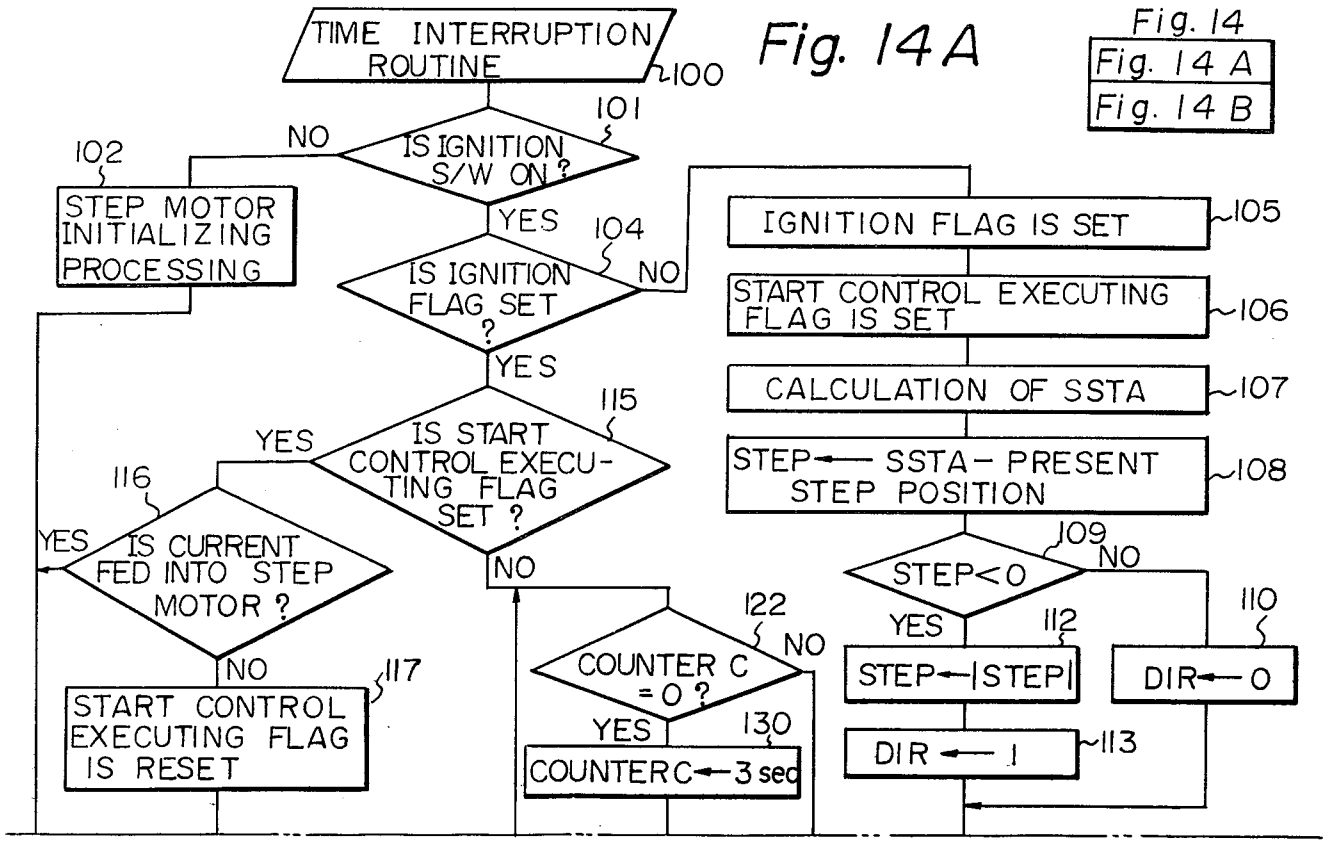
Fig. 14
Fig. 14 A
Fig. 14 B
Fig. 14A
TIME INTERRUPTION ROUTINE
100
101
IS IGNITION S/W ON ?
YES
NO
102
STEP MOTOR INITIALIZING PROCESSING
104
IS IGNITION FLAG SET ?
YES
NO
105
IGNITION FLAG IS SET
106
START CONTROL EXECUTING FLAG IS SET
107
CALCULATION OF SSTA
108
STEP ← SSTA − PRESENT STEP POSITION
109
STEP<0
NO
YES
110
DIR ← 0
112
STEP ← |STEP|
113
DIR ← 1
115
IS START CONTROL EXECUTING FLAG SET ?
YES
NO
116
IS CURRENT FED INTO STEP MOTOR ?
YES
NO
117
START CONTROL EXECUTING FLAG IS RESET
122
COUNTER C = 0 ?
YES
NO
130
COUNTER C ← 3 sec

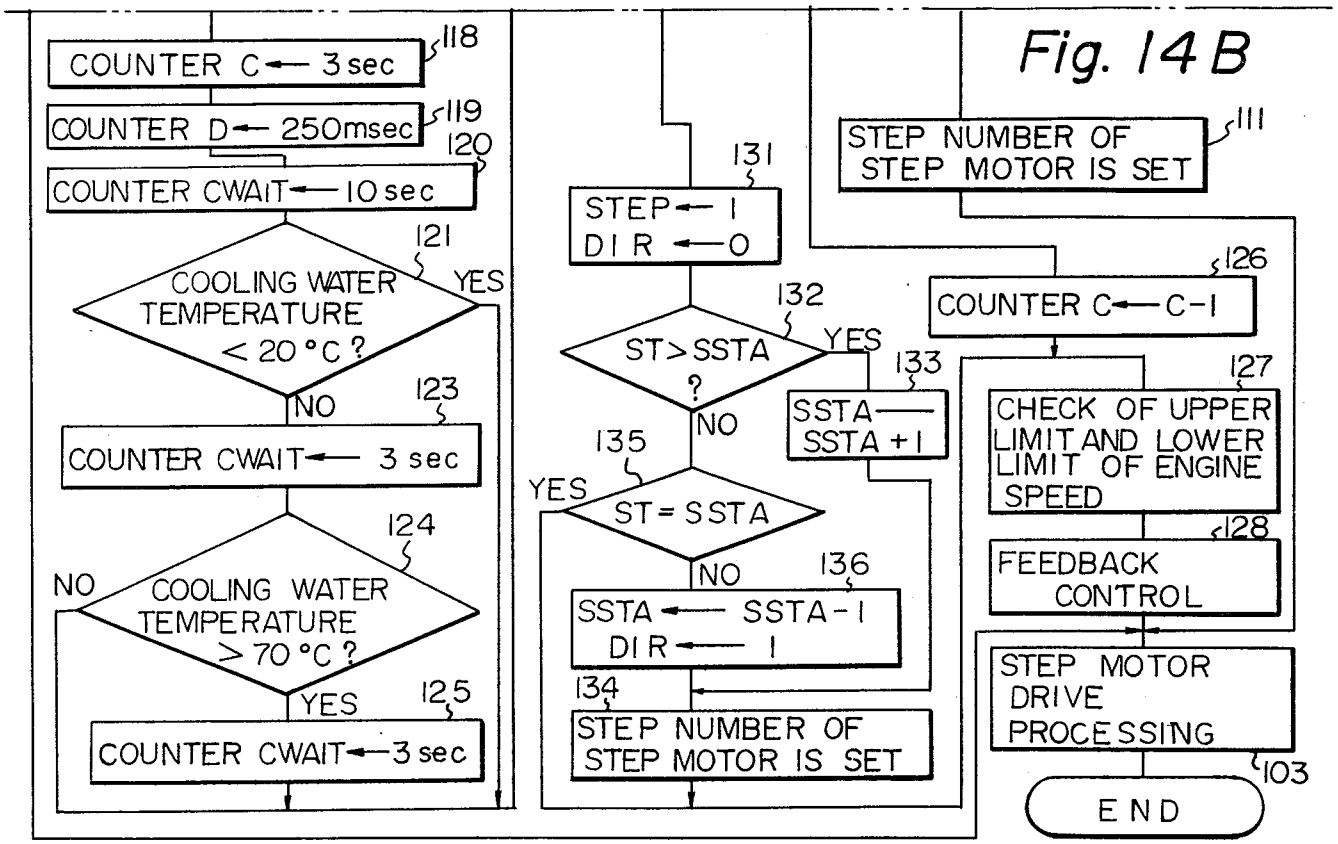
Fig. 14B
111
STEP NUMBER OF STEP MOTOR IS SET
126
COUNTER C ← C-1
127
CHECK OF UPPER LIMIT AND LOWER LIMIT OF ENGINE SPEED
128
FEEDBACK CONTROL
STEP MOTOR DRIVE PROCESSING
103
END
133
SSTA ← SSTA+1
YES
131
STEP ← 1
DIR ← 0
132
ST > SSTA ?
NO
135
ST = SSTA
YES
NO
136
SSTA ← SSTA-1
DIR ← 1
134
STEP NUMBER OF STEP MOTOR IS SET
118
COUNTER C ← 3 sec
119
COUNTER D ← 250msec
120
COUNTER CWAIT ← 10 sec
121
COOLING WATER TEMPERATURE < 20 °C ?
YES
NO
123
COUNTER CWAIT ← 3 sec
124
COOLING WATER TEMPERATURE > 70 °C ?
NO
YES
125
COUNTER CWAIT ← 3 sec CHECK OF UPPER LIMIT AND LOWER LIMIT OF ENGINE SPEED
150
COUNTER CWAIT = 0 ?
YES
NO
151
COUNTER CWAIT ← CWAIT-1
152
COUNTER D = 0 ?
YES
NO
153
COUNTER D ← D-1
154
COUNTER ← 250 m sec
155
VEHICLE SPEED 2 km/h ?
YES
NO
156
IS THROTTLE SW ON ?
YES
NO
165
IS NEUTRAL S/W ON
YES
NO
166
CALCULATION OF MAX AND MIN
167
ΔE = TE - TE1
168
ΔE ≥ 0 ?
NO
NO
169
CALCULATION OF MAX AND MIN
170
CALCULATION OF MAX AND MIN
171
MAX > NEU ?
YES
NO
173
NEU ← MAX

METHOD AND APPARATUS FOR CONTROLLING THE IDLING SPEED OF AN ENGINE

CROSS REFERENCE TO RELATED APPLICATIONS

This application is related to U.S. application Ser. Nos. 239,641 filed Mar. 2, 1981; 244,115 filed Mar. 16, 1981; 271,931 filed June 9, 1981; 279,515 filed July 1, 1981; 281,854 filed July 9, 1981; 286,713 filed July 24, 1981 and 302,390 filed Sept. 15, 1981, which are all assigned to the same assignee as the present invention.

BACKGROUND OF THE INVENTION

The present invention relates to a method of and apparatus for controlling the idling speed of an internal combustion engine.

An idling speed control device has been known in which a bypass passage is branched off from the intake passage of an engine, which is located upstream of a throttle valve, and connected again to the intake passage located downstream of the throttle valve, with a diaphragm type vacuum operated control valve device being arranged in the bypass passage. The diaphragm vacuum chamber of the control valve device is connected via a vacuum conduit to the intake passage located downstream of the throttle valve, and an electromagnetic control valve is arranged in the vacuum conduit for controlling the cross-sectional area of the vacuum conduit. In this idling speed control device, at the time of idling, the level of the vacuum produced in the diaphragm vacuum chamber of the control valve device is controlled by controlling the electromagnetic control valve in accordance with the operating condition of the engine and, in addition, the air flow area of the bypass passage is controlled in accordance with a change in the level of the vacuum produced in the diaphragm vacuum chamber. As a result of this, the amount of air fed into the cylinders of the engine from the bypass passage is controlled.

However, in such a conventional idling speed control device, firstly, in the case wherein a vehicle is used in a cold region, the electromagnetic control valve becomes frozen and, thus, it is impossible to control the cross-sectional area of the vacuum conduit. As a result of this, since it is also impossible to control the air flow area of the bypass passage, a problem occurs in that it is impossible to control the amount of air fed into the cylinders from the bypass passage. Secondly, in a conventional idling speed control device, since the diaphragm type vacuum operated control valve device is used, the controllable range of the air flow area of the bypass passage is very narrow. Therefore, even if the control valve device is fully opened, air, the amount of which is necessary to operate the engine at the time of fast idling, cannot be fed into the cylinders of the engine from the bypass passage. Consequently, in a conventional idling speed control device, an additional bypass passage is provided in addition to the regular bypass passage, and a valve, which is actuated by a bimetallic element, is arranged in the additional bypass passage. When the temperature of the engine is low, the valve, which is actuated by the bimetallic element, opens. As a result of this, since additional air is fed into the cylinders of the engine from the additional bypass passage, in addition to the air fed into the cylinders of the engine from the regular bypass passage, the amount of air, which is necessary to operate the engine at the time of fast idling, can be ensured.

As mentioned above, in a conventional idling speed control device, since the additional bypass passage and the valve, actuated by the bimetallic element, are necessary, in addition to the regular bypass passage, a problem occurs in that the construction of the idling speed control device will be complicated. In addition, since the amount of air fed into the cylinders of the engine is controlled by only the expanding and shrinking action of the bimetallic element at the time of fast idling, there is a problem in that it is impossible to precisely control the amount of air fed into the cylinders of the engine.

SUMMARY OF THE INVENTION

An object of the present invention is to provide a novel method of and apparatus for controlling the idling speed, which method and apparatus are capable of precisely controlling the amount of air flowing within the bypass passage at the time of idling and maintaining the idling speed of the engine at an optimum speed.

According to the present invention, there is provided a method and apparatus for controlling an idling speed of an engine comprising a main intake passage, a throttle valve arranged in the main intake passage, a bypass passage branched off from the main intake passage upstream of the throttle valve and connected to the main intake passage downstream of the throttle valve, a control valve arranged in the bypass passage, and a stepper motor actuating the control valve for controlling the amount of air flowing within the bypass passage. The method comprises: detecting the idling speed of the engine; rotating the stepper motor in a rotating direction wherein the flow area of the control valve is reduced when the idling speed of the engine is increased beyond a predetermined upper limit of the idling speed for decreasing the idling speed below said predetermined upper limit, and; rotating the stepper motor in a rotating direction wherein the flow area of the control valve is increased when the idling speed of the engine is decreased below a predetermined lower limit of the idling speed for increasing the idling speed beyond said predetermined lower limit.

The present invention may be more fully understood from the description of a preferred embodiment of the invention set forth below, together with the accompanying drawings.

BRIEF DESCRIPTION OF THE DRAWINGS

In the drawings:

FIG. 14 is a flow chart illustrating the general flow of the operation of an embodiment according to the present invention;

DESCRIPTION OF A PREFERRED EMBODIMENT

Figure 1:
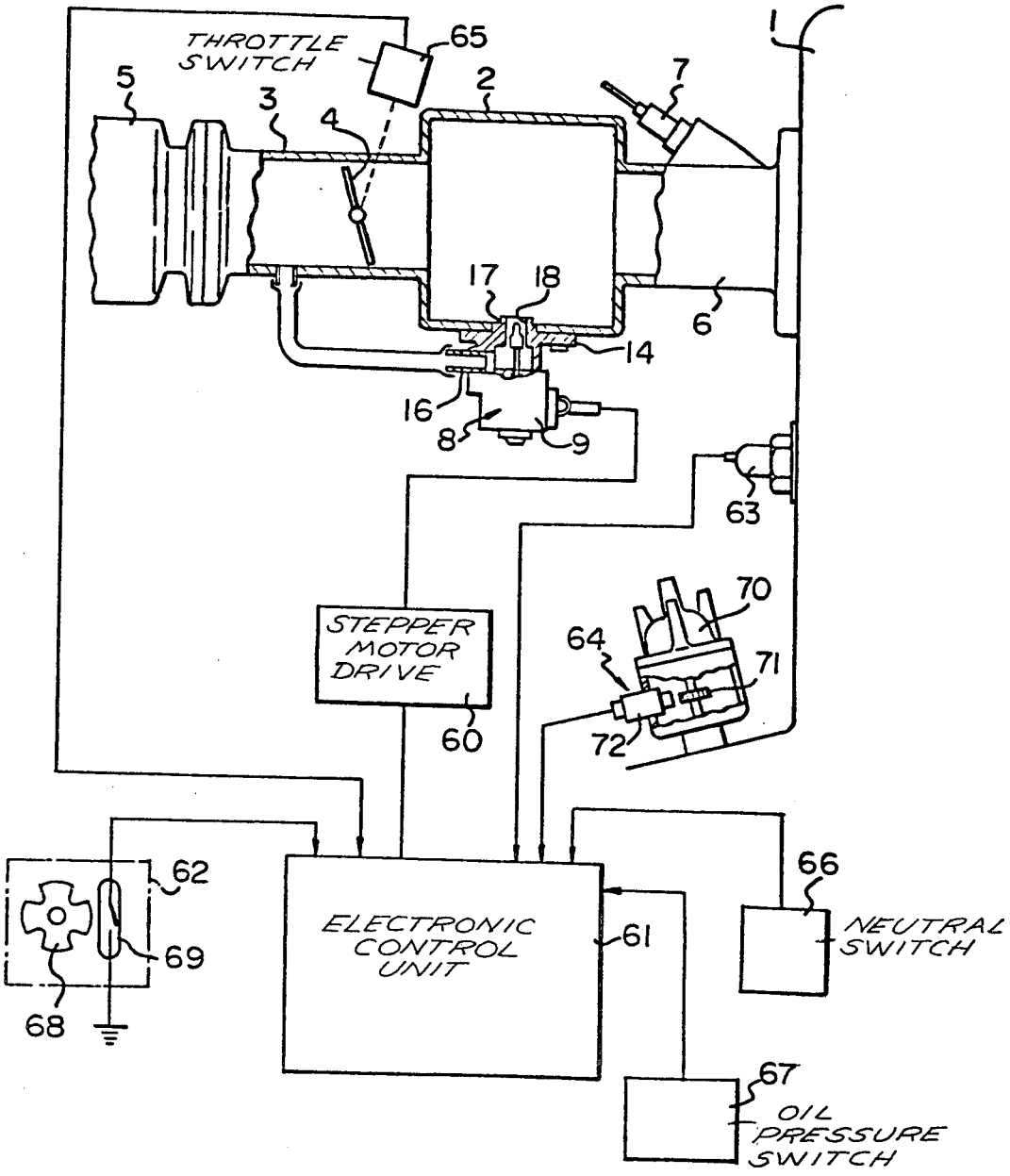
FIG. 1 is a side view, partly in cross-section, of an intake system equipped with an idling speed control device according to the present invention.
Figure 2:
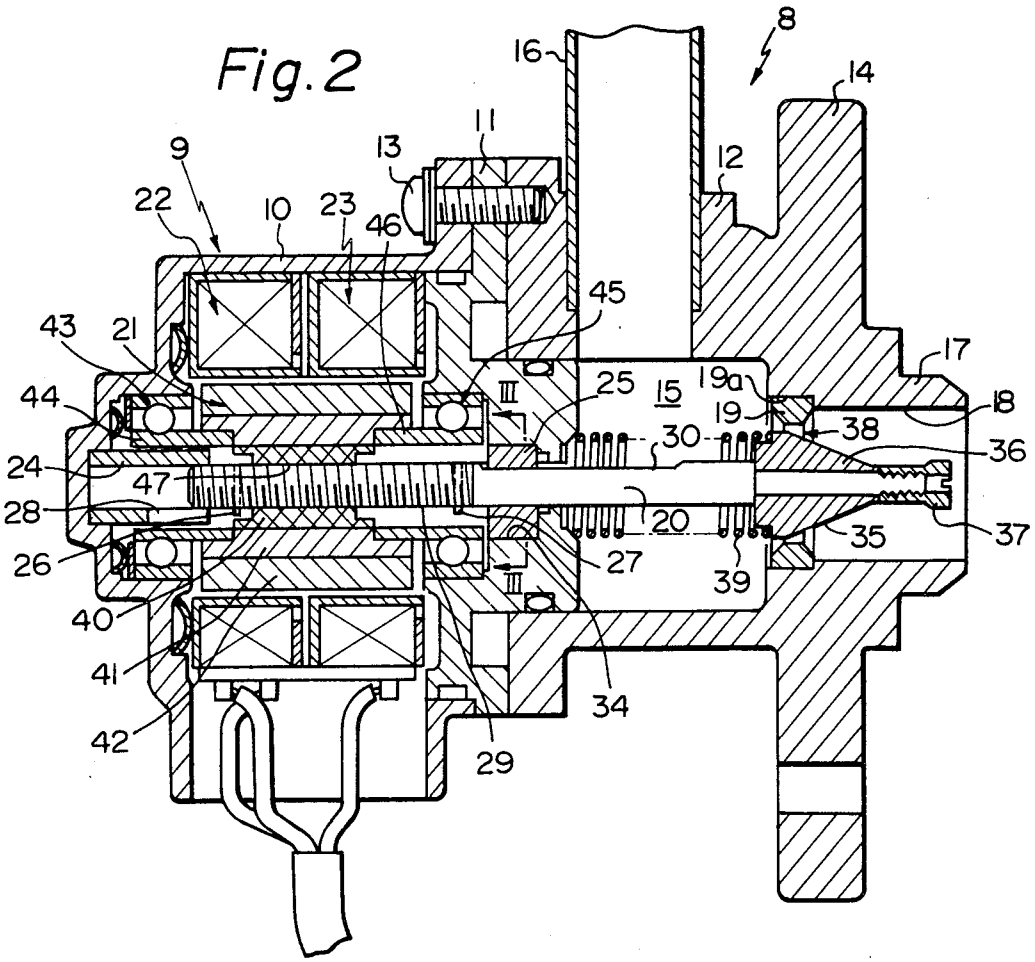
FIG. 2 is a cross-sectional side view of a flow control valve device.

Referring to FIG. 1, 1 designates an engine body, 2 a surge tank, 3 an intake duct, 4 a throttle valve and 5 an air flow meter. The inside of the intake duct 3 is connected to the atmosphere via the air flow meter 5 and an air cleaner (not shown). The surge tank 2, which is common to all the cylinders of the engine, has a plurality of branch pipes 6, each being connected to the corresponding cylinder of the engine. A fuel injector 7 is provided for each cylinder and mounted on the corresponding branch pipe 6. In addition, a flow control valve device 8 is mounted on the surge tank 2. As illustrated in FIG. 2, the flow control valve device 8 comprises a motor housing 10 of a stepper motor 9, a motor housing end plate 11 and a valve housing 12. The motor housing 10, the end plate 11 and the valve housing 12 are interconnected to each other by means of bolts 13. As illustrated in FIGS. 1 and 2, a flange 14 is formed in one piece on the valve housing 12 and fixed onto the outer wall of the surge tank 2. A valve chamber 15 is formed in the valve housing 12 and connected via a bypass pipe 16, fixed onto the valve housing 12, to the inside of the intake duct 3, which is located upstream of the throttle valve 4. In addition, a hollow cylindrical projection 17, projecting into the surge tank 2, is formed in one piece on the side wall of the flange 14, and a cylindrical air outflow bore 18 is formed in the hollow cylindrical projection 17. An annular groove 19*a* is formed on the inner end of the air outflow bore 18, and a valve seat 19 is fitted into the annular groove 19*a*.

Figure 3:
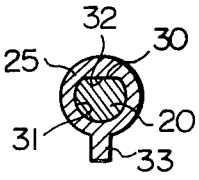
FIG. 3 is a cross-sectional view taken along the line III—III in FIG. 2.
Figure 4:
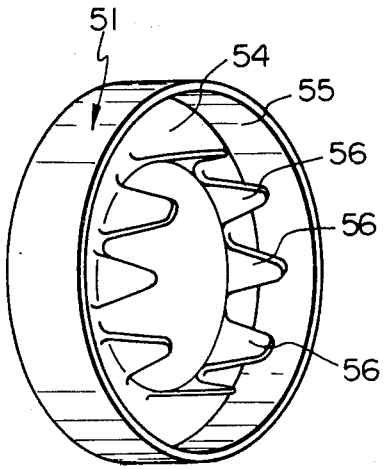
FIG. 4 is a perspective view of a stator core member.
Figure 5:
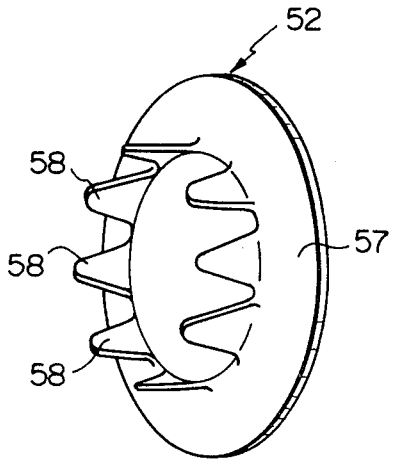
FIG. 5 is a perspective view of a stator core member.

As illustrated in FIG. 2, the stepper motor 9 comprises a valve shaft 20, a rotor 21 coaxially arranged with the valve shaft 20, and a pair of stators 22, 23, each being stationarily arranged in the motor housing 10 and spaced from the cylindrical outer wall of the rotor 21 by a slight distance. The end portion of the valve shaft 20 is supported by a hollow cylindrical bearing 24 made of a sintered metal and fixed onto the motor housing 10, and the intermediate portion of the valve shaft 20 is supported by a hollow cylindrical bearing 25 made of a sintered metal and fixed onto the end plate 11. A first stop pin 26, which abuts against the rotor 21 when the valve shaft 20 reaches the most advanced position, is fixed onto the valve shaft 20, and a second stop pin 27, which abuts against the rotor 21 when the valve shaft 20 reaches the most retracted position, is fixed onto the valve shaft 20. In addition, an axially extending slot 28, into which the first stop pin 26 is able to enter, is formed in the bearing 24. External screw threads 29 are formed on the outer circumferential wall of the valve shaft 20, which is located within the motor housing 10. The external screw threads 29 extend towards the right in FIG. 2 from the left end of the valve shaft 20 and terminate at a position wherein the valve shaft 20 passes through the second stop pin 27 by a slight distance. In addition, an axially extending flat portion 30, which extends towards the right in FIG. 2 from a position near the terminating position of the external screw threads 29, is formed on the outer circumferential wall of the valve shaft 20. As illustrated in FIG. 3, the inner wall of the shaft bearing hole of the bearing 25 comprises a cylindrical wall portion 31 and a flat wall portion 32 which have a complementary shape relative to the outer circumferential wall of the valve shaft 20. Consequently, the valve shaft 20 is supported by the bearing 25 so that the valve shaft 20 cannot be rotated, but is able to slide in the axial direction. In addition, as illustrated in FIG. 3, an outwardly projecting arm 33 is formed in one piece on the outer circumferential wall of the bearing 25, and a bearing receiving hole 34 (FIG. 2), having a contour shape which is the same as that of the bearing 25, is formed on the inner wall of the end plate 11. Consequently, when the bearing 25 is fitted into the bearing receiving hole 34, as illustrated in FIG. 2, the bearing 25 is non-rotatably supported by the end plate 11. A valve head 36, having a substantially conical shaped outer wall 35, is secured onto the tip of the valve shaft 20 by means of a nut 37, and an annular air flow passage 38 is formed between the valve seat 19 and the conical outer wall 35 of the valve head 36. In addition, a compression spring 39 is inserted between the valve head 36 and the end plate 11 in the valve chamber 15.

As illustrated in FIG. 2, the rotor 21 comprises a hollow cylindrical inner body 40 made of a synthetic resin, a hollow cylindrical intermediate body 41 made of a metallic material and rigidly fitted onto the outer circumferential wall of the hollow cylindrical inner body 40, and a hollow cylindrical outer body 42 made of a permanent magnet and fixed onto the outer circumferential wall of the hollow cylindrical intermediate body 41 by using an adhesive. As will be hereinafter described, an N pole and an S pole are alternately formed on the outer circumferential wall of the hollow cylindrical outer body 42 made of a permanent magnet along the circumferential direction of the outer circumferential wall of the hollow cylindrical outer body 42. As illustrated in FIG. 2, one end of the hollow cylindrical intermediate body 41 is supported by the inner race 44 of a ball bearing 43 which is supported by the motor housing 10, and the other end of the hollow cylindrical intermediate body 41 is supported by the inner race 46 of a ball bearing 45 which is supported by the end plate 11. Consequently, the rotor 21 is rotatably supported by a pair of the ball bearings 43 and 45. Internal screw threads 47, which are in engagement with the external screw threads 29 of the valve shaft 20, are formed on the inner wall of the central bore of the hollow cylindrical inner body 40. Therefore, when the rotor 21 rotates, the valve shaft 20 is caused to move in the axial direction.

Figure 7:
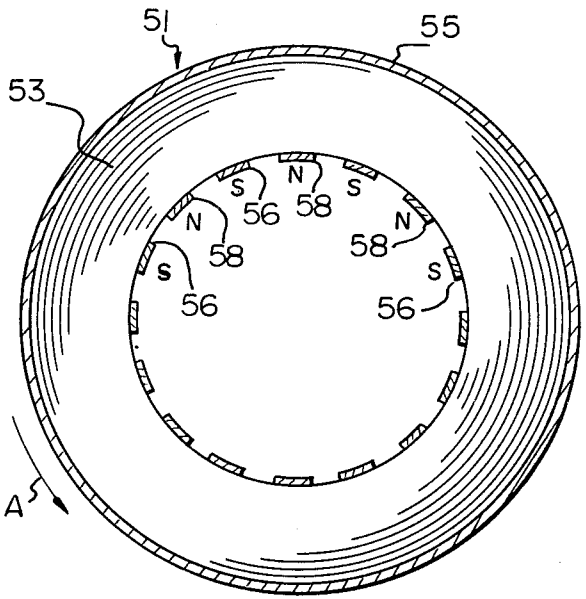
FIG. 7 is a cross-sectional view taken along the line VII—VII in FIG. 6.
Figure 6:
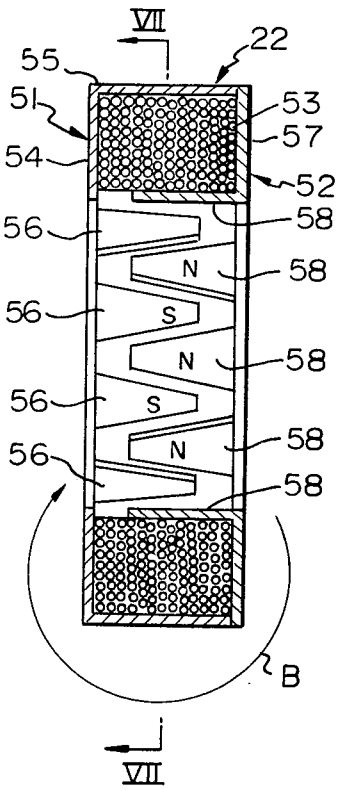
FIG. 6 is a cross-sectional side view of a stator.

The stators 22 and 23, which are stationarily arranged in the motor housing 10, have the same construction and, therefore, the construction of only the stator 22 will be hereinafter described with reference to FIGS. 4 through 7. Referring to FIGS. 4 through 7, the stator 22 comprises a pair of stator core members 51 and 52, and a stator coil 53. The stator core member 51 comprises an annular side wall portion 54, an outer cylindrical portion 55, and eight pole pieces 56 extending perpendicular to the annular side wall portion 54 from the inner periphery of the annular side wall portion 54. The pole pieces 56 have a substantially triangular shape, and each of the pole pieces 56 is spaced from the adjacent pole piece 56 by the same angular distance. On the other hand, the stator core member 52 comprises an annular side wall portion 57 and eight pole pieces 58 extending perpendicular to the annular side wall portion 57 from the inner periphery of the annular side wall portion 57. The pole pieces 58 have a substantially triangular shape, and each of the pole pieces 58 is spaced from the adjacent pole piece 58 by the same angular distance. The stator core members 51 and 52 are assembled so that each of the pole pieces 56 is spaced from the adjacent pole piece 58 by the same angular distance as illustrated in FIGS. 6 and 7. When the stator core members 51 and 52 are assembled, the stator core members 51 and 52 construct a stator core. When an electric current is fed into the stator coil 53 and flows within the stator coil 53 in the direction illustrated by the arrow A in FIG. 7, a magnetic field, the direction of which is as illustrated by the arrow B in FIG. 6, is generated around the stator coil 53. As a result of this, the S poles are produced in the pole pieces 56 and, at the same time, the N poles are produced in the pole pieces 58. Consequently, it will be understood that an N pole and an S pole are alternately formed on the inner circumferential wall of the stator 22. On the other hand, if an electric current flows within the stator coil 22 in the direction which is opposite to that illustrated by the arrow A in FIG. 7, the N poles are produced in the pole pieces 56 and, at the same time, the S poles are produced in the pole pieces 58.

Figure 8:
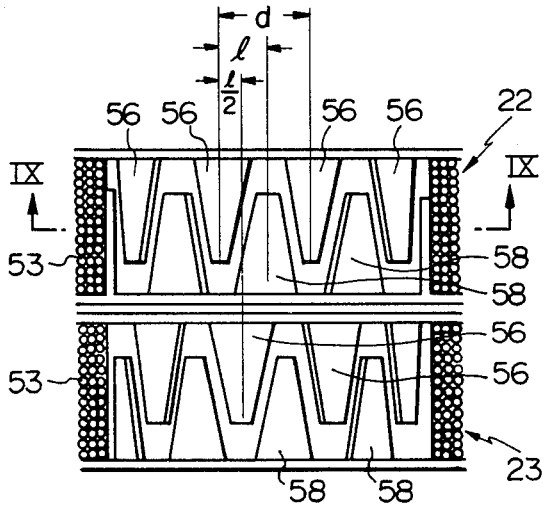
FIG. 8 is a cross-sectional plan view of the stator illustrated in FIG. 2.
Figure 9:
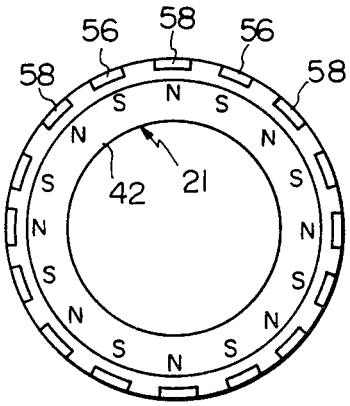
FIG. 9 is a schematic cross-sectional side view taken along the line IX—IX in FIG. 8.

FIG. 8 illustrates the case wherein the stator 22 and the stator 23 are arranged in tandem, as illustrated in FIG. 2. In FIG. 8, similar components of the stator 23 are indicated with the same reference numerals used in the stator 22. As illustrated in FIG. 8, assuming that the distance between the pole piece 56 of the stator 22 and the adjacent pole piece 58 of the stator 22 is indicated by l, each of the pole pieces 56 of the stator 23 is offset by l/2 from the pole piece 56 of the stator 22, which is arranged nearest to the pole piece 56 of the stator 23. That is, assuming that the distance d between the adjacent pole pieces 56 of the stator 23 is one pitch, each of the pole pieces 56 of the stator 23 is offset by a $\frac{1}{4}$ pitch from the pole piece 56 of the stator 22, which is arranged nearest to the pole piece 56 of the stator 23. On the other hand, as illustrated in FIG. 9, an N pole and an S pole are alternately formed on the outer circumferential wall of the hollow cylindrical outer body 42 of the rotor 21 along the circumferential direction of the outer circumferential wall of the hollow cylindrical outer body 42, and the distance between the N pole and the S pole, which are arranged adjacent to each other, is equal to the distance between the pole piece 56 and the pole piece 58 of the stator 22 or 23, which are arranged adjacent to each other.

Turning to FIG. 1, the stepper motor 9 is connected to an electronic control unit 61 via a stepper motor drive circuit 60. In addition, a vehicle speed sensor 62, a cooling water temperature sensor 63, an engine speed sensor 64, a throttle switch 65, a neutral switch 66 of the automatic transmission (not shown) and a lubricating oil pressure reactive switch 67 are connected to the electronic control unit 61. The vehicle speed sensor 62 comprises, for example, a rotary permanent magnet 68 arranged in the speed meter (not shown) and rotated by the speed meter cable (not shown), and a reed switch 69 actuated by the rotary permanent magnet 68. A pulse signal, having a frequency which is proportional to the vehicle speed, is input into the electronic control unit 61 from the vehicle speed sensor 62. The cooling water temperature sensor 63 is provided for detecting the cooling water of the engine, and a signal, representing the temperature of the cooling water, is input into the electronic control unit 61 from the cooling water temperature sensor 63. The engine speed sensor 64 comprises a rotor 71 rotating in a distributor 70 in synchronization with the rotation of the crank shaft (not shown), and an electromagnetic pick-up 72 arranged to face the saw tooth shaped outer periphery of the rotor 71. A pulse is input into the electronic control unit 61 from the engine speed sensor 64 everytime the crank shaft rotates at a predetermined angle. The throttle switch 65 is operated by the rotating motion of the throttle valve 4 and turned to the ON position when the throttle valve 4 is fully closed. The operation signal of the throttle switch 65 is input into the electronic control unit 61. The neutral switch 66 is provided for detecting whether the automatic transmission is in the drive range D or in the neutral range N, and the detecting signal of the neutral switch 66 is input into the electronic control unit 61.

Figure 11:
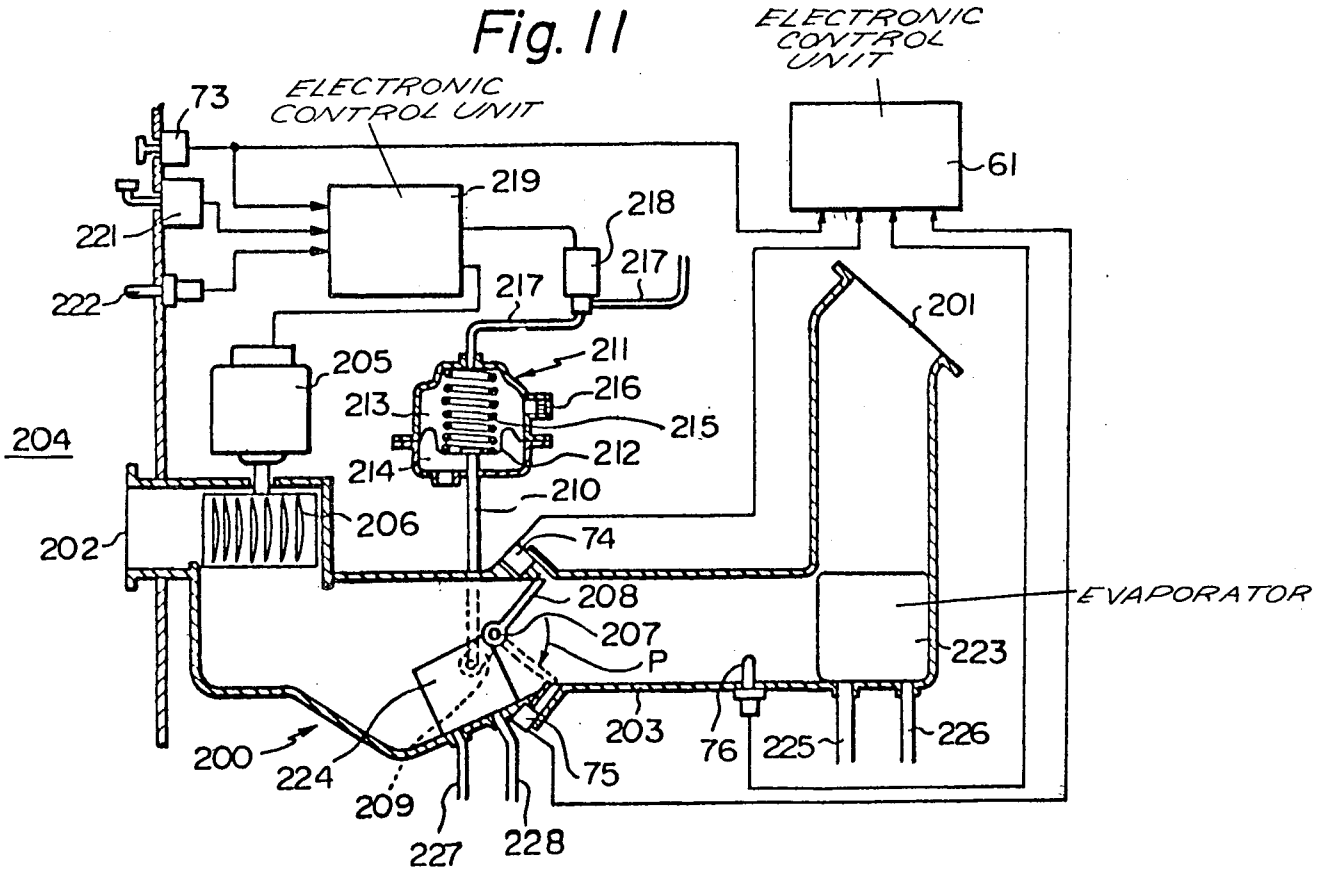
FIG. 11 is a schematic view of an air conditioning device.

FIG. 11 illustrates an air conditioning device 200. Referring to FIG. 11, the air conditioning device 200 comprises an air duct 203 having an air inlet 201 and an air outlet 202. The air inlet 201 is open to the atmosphere, and the air outlet 202 is open to a driver's compartment 204. A fan 206, driven by a motor 205, is arranged in the air duct 203 and, when the fan 206 is rotated, ambient air, sucked into the air duct 203 from the air inlet 201, is discharged into the driver's compartment 204 from the air outlet 202. In addition, an air mix damper 208, fixed onto a swing shaft 207, is arranged in the air duct 203. An arm 209 is fixed onto the swing shaft 207, and the tip of the arm 209 is connected to a diaphragm 212 of a vacuum diaphragm apparatus 211 via a control rod 210. The vacuum diaphragm apparatus 211 comprises a vacuum chamber 213 and an atmospheric pressure chamber 214 which are separated by a diaphragm 212, and a compression spring 215 for biasing the diaphragm 212 towards the atmospheric pressure chamber 214 is arranged in the vacuum chamber 213. The vacuum chamber 213 is connected, on one hand, to the atmosphere via a restricted opening 216 and, on the other hand, to the surge tank 2 (FIG. 1) via a vacuum conduit 217 and an electromagnetic valve 218. As illustrated in FIG. 11, the electromagnetic valve 218 is connected to the output terminal of an electronic control unit 219 for the air conditioning device 200. In addition, an air conditioning switch 73, a driver's compartment temperature setting device 221 and a driver's compartment temperature sensor 222 are connected to the input terminals of the electronic control unit 219. Continuous pulses are applied to the solenoid of the electromagnetic valve 218 from the electronic control unit 219, and the opening time duration of the electromagnetic valve 218 is increased as the duty cycle of the continuous pulses is increased. On the other hand, an evaporator 223 for cooling air and a heat exchanger 224 for heating air are arranged in the air duct 203. Coolant is fed via a coolant inflow conduit 225 into the evaporator 223 from a compressor (not shown) driven by the engine and, then, the coolant is returned to the compressor via a coolant outflow conduit 226 after the coolant absorbs heat from air flowing within the air duct 203. On the other hand, cooling water of the engine is fed into the heat exchanger 224 via a cooling water inflow conduit 227 and, then, the cooling water is returned to the radiator (not shown) via a cooling water outflow conduit 228 after the cooling water provides heat for air flowing within the air duct 203.

When the air conditioning switch 73 is turned to the ON position, the motor 205 is rotated, and the opening control of the electromagnetic valve 218 is started. As mentioned above, the opening time duration of the electromagentic valve 218 is increased as the duty ratio of the continuous pulse applied to the electromagnetic valve 218 is increased. Consequently, the level of vacuum produced in the vacuum chamber 213 becomes great as the duty cycle of the continuous pulses is increased. If the level of vacuum produced in the vacuum chamber 213 becomes great, since the diaphragm 212 moves upwards against the compression spring 215, the air mix damper 208 is rotated in the direction illustrated by the arrow P in FIG. 11. As a result of this, since the amount of air passing through the heat exchanger 224 is reduced, the temperature of air fed into the driver's compartment 204 becomes low. Contrary to this, if the duty cycle of the continuous pulses applied to the electromagnetic valve 218 is reduced, since the opening time duration of the electromagnetic valve 218 is reduced, the level of vacuum produced in the vacuum chamber 213 becomes small. As a result of this, since the diaphragm 212 moves downwards, the air mix damper 208 is rotated in the direction which is opposite to the direction P. Therefore, since the amount of air passing through the heat exchanger 224 is increased, the temperature of air fed into the driver's compartment 204 is increased. The position of the air mix damper 208 is controlled by the driver's compartment temperature setting device 221 so that the temperature in the driver's compartment 204, which is set by the driver, becomes equal to the actual temperature in the driver's compartment 204, which is detected by the driver's compartment temperature sensor 222.

As illustrated in FIG. 11, a hot max. switch 74 and a cool max. switch 75 are arranged in the air duct 203. When the air mix damper 208 is located at a position illustrated by the solid line in FIG. 11, the hot max. switch 74 comes into engagement with the air mix damper 208 and is turned to the ON position. When the air mix damper 208 is located in the position illustrated by the solid line in FIG. 11, the entire air, flowing within the air duct 203, passes through the heat exchanger 224. Consequently, when air, fed into the driver's compartment 204 via the air duct 203, is heated to the maximum, the hot max. switch 74 is turned to the ON position. At this time, the evaporator 223 serves to dehumidify air flowing within the air duct 203. On the other hand, when the air mix damper 208 is located in the position illustrated by the broken line in FIG. 11, the cool max. switch 75 comes into engagement with the air mix damper 208 and is turned to the ON position. When the air mix damper 208 is located in the position illustrated by the broken line in FIG. 11, the entire air, flowing within the air duct 203, is cooled by the evaporator 223 without being heated by the heat exchanger 224. Consequently, when air, fed into the driver's compartment 204 via the air duct 203, is cooled to the maximum, the cool max. switch 75 is turned to the ON position. In addition, a temperature sensor 76 for detecting the temperature of air which has passed through the evaporator 223 is arranged in the air duct 203 at a position located near and downstream of the evaporator 223. As illustrated in FIG. 11, the air conditioning switch 73, the hot max. switch 74, the cool max. switch 75 and the temperature sensor 76 are connected to the electronic control unit 61.

Figures 10, 10A:
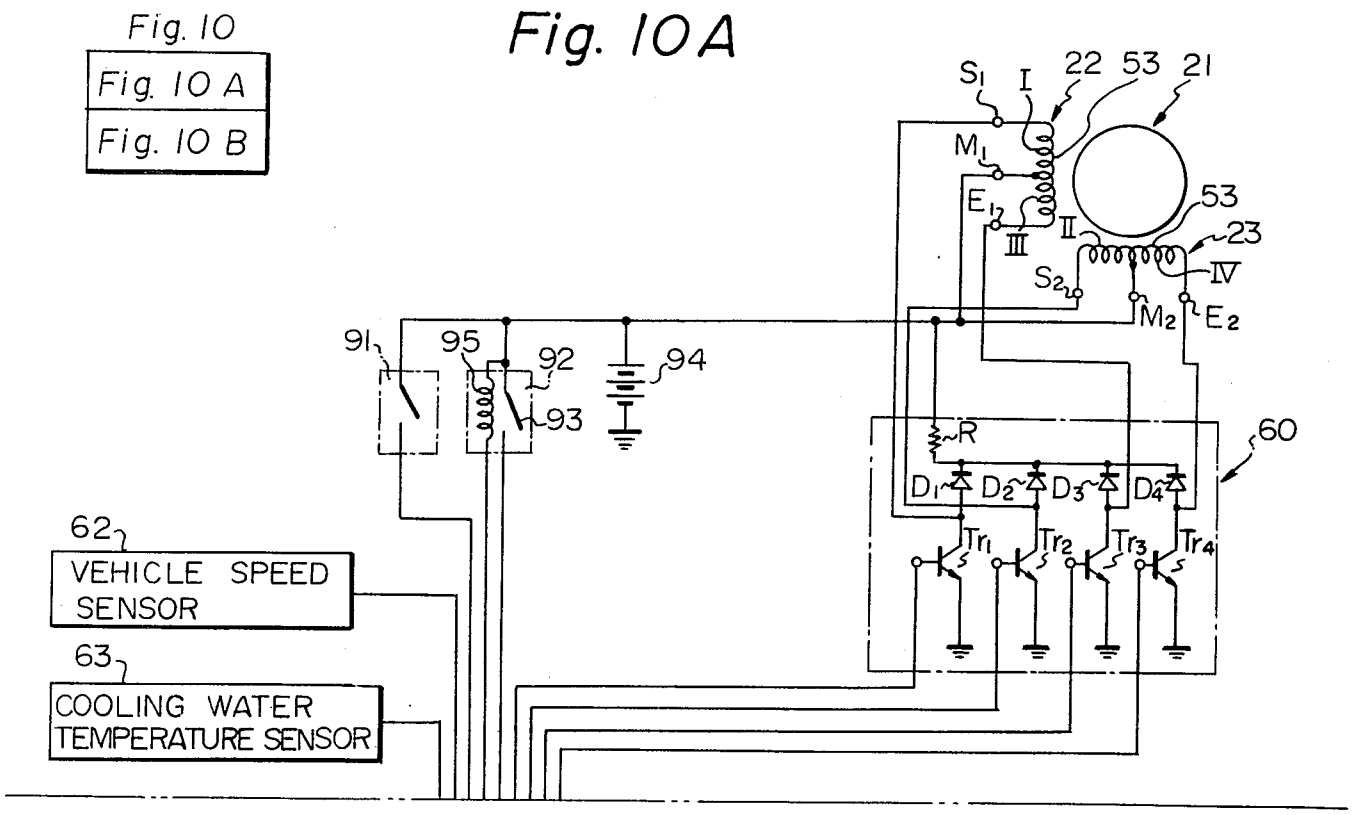
FIG. 10 is a circuit of an electronic control unit.
Figure 10B:
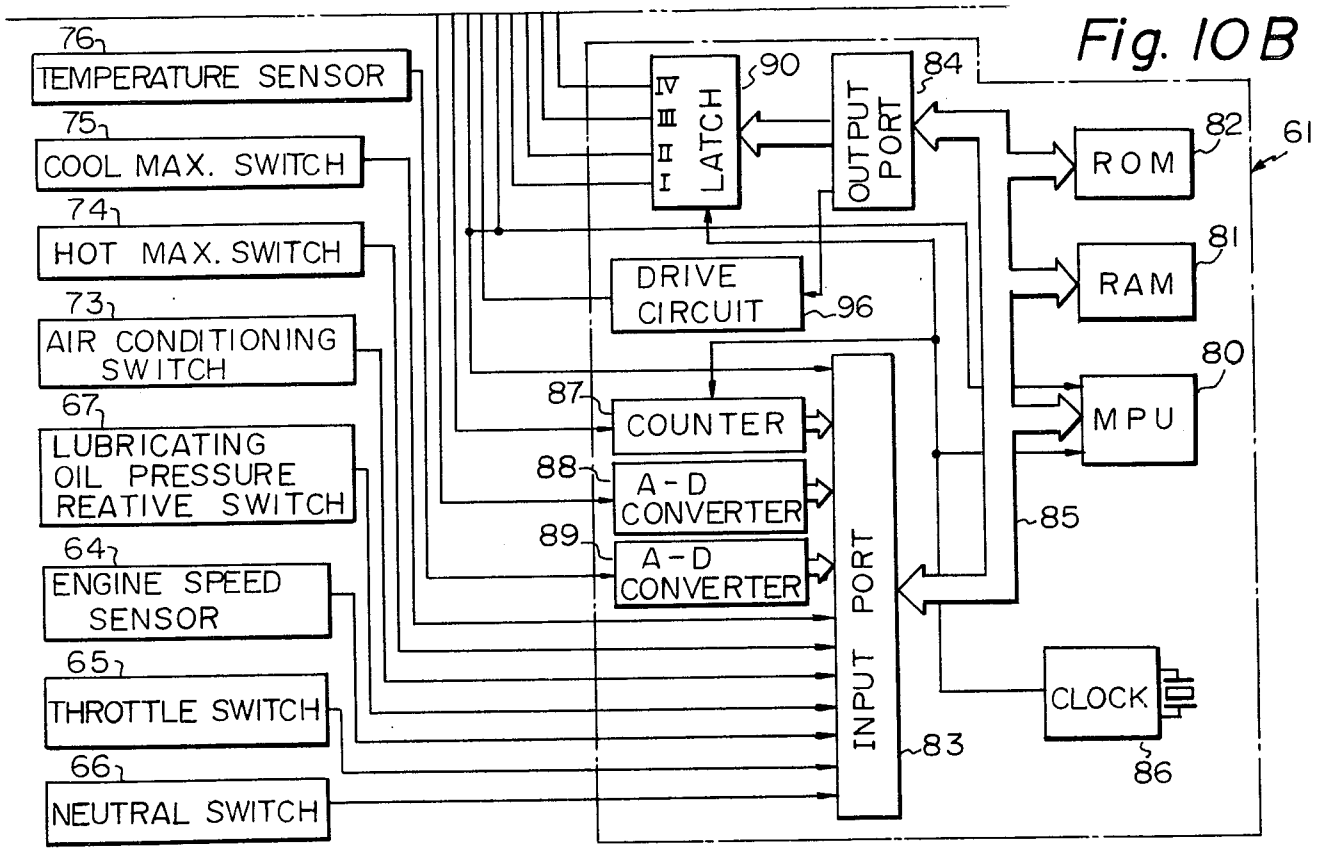

FIG. 10 illustrates the stepper motor drive circuit 60 and the electronic control unit 61. Referring to FIG. 10, the electronic control unit 61 is constructed as a digital computer and comprises a microprocessor (MPU) 80 executing the arithmetic and logic processing, a random-access memory (RAM) 81, a read-only memory (ROM) 82 storing a predetermined control program and an arithmetic constant therein, an input port 83 and an output port 84 are all interconnected to each other via a bidirectional bus 85. In addition, the electronic control unit 61 comprises a clock generator 86 generating various clock signals. Furthermore, the electronic control unit 61 comprises a counter 87, and the vehicle speed sensor 62 is connected to the input port 83 via the counter 87. The number of output pulses issued from the vehicle speed sensor 62 is counted for a fixed time period in the counter 87 determined by the clock signal of the clock generator 86, and the binary coded count value, which is proportional to the vehicle speed, is input into the MPU 80 via the input port 83 and the bus 85 from the counter 87. In addition, the electronic control unit 61 comprises a pair of A-D converters 88, 89. The cooling water temperature sensor 63 is connected to the input port 83 via the A-D converter 88, and the temperature sensor 76 is connected to the input port 83 via the A-D converter 89. The cooling water temperature sensor 63 comprises, for example, a thermistor element and produces an output voltage which is proportional to the temperature of the cooling water of the engine. The output voltage of the cooling water temperature sensor 63 is converted to the corresponding binary code in the A-D converter 88, and the binary code is input into the MPU 80 via the input port 83 and the bus 85. The temperature sensor 76 also comprises, for example, a thermistor element and produces an output voltage which is proportional to the temperature of air flowing within the air duct 203 located downstream of the evaporator 223. The output voltage of the temperature sensor 76 is converted to the corresponding binary code in the A-D converter 89, and the binary code is input into the MPU 80 via the input port 83 and the bus 85. The output signals of the cool max. switch 75, the hot max. switch 74, the air conditioning switch 73, the lubricating oil pressure reactive switch 67, the engine speed sensor 64, the throttle switch 65 and the neutral switch 66 are input into the MPU 80 via the input port 83 and the bus 85. In the MPU 80, the time interval of the output pulses issuing from the engine speed sensor 64 is calculated, and the engine speed is calculated from the time interval. On the other hand, the output terminals of the output port 84 are connected to the corresponding input terminals of the latch 90, and the output terminals of the latch 90 are connected to the stepper motor drive circuit 60. Stepper motor drive data, obtained in the MPU 80, is written in the output port 84, and the stepper motor drive data is retained in the latch 90 for a fixed time period determined by the clock signal of the clock generator 86. The power source terminal of the electronic control unit 61 is connected to a power source 94 via an ignition switch 91 and the switch 93 of a relay 92, which are arranged in parallel. The switch 93 is actuated by the coil 95 of the relay 92. One of the ends of the coil 95 is connected to the power source 94, and the other end of the coil 95 is connected to the output port 84 via a drive circuit 96. In addition, the opening and closing operation of the ignition switch 91 is input into the MPU 80 via the input port 83 and the bus 85.

On the other hand, in FIG. 8, the stator coil 53 of the stator 22 is wound in the direction which is the same as the winding direction of the stator coil 53 of the stator 23. In FIG. 10, the winding start terminals of the stator coils 53 of the stators 22 and 23 are indicated by $S_1$ and $S_2$, respectively, and the winding end terminals of the stator coils 53 of the stators 22 and 23 are indicated by $E_1$ and $E_2$, respectively. In addition, in FIG. 10, the intermediate taps of the stator coils 53 of the stators 22 and 23 are indicated by $M_1$ and $M_2$, respectively. In the stator 22, the stator coil 53, located between the winding start terminal $S_1$ and the intermediate tap $M_1$, constitutes a first phase exciting coil I, and the stator coil 53, located between the winding end terminal $E_1$ and the intermediate tap $M_1$, constitutes a second phase exciting coil II. In addition, in the stator 23 the stator coil 53, located between the winding start terminal $S_2$ and the intermediate terminal $M_2$, constitutes a third phase exciting coil III, and the stator coil 53, located between the winding end terminal $E_2$ and the intermediate tap $M_2$, constitutes a fourth phase exciting coil IV. As illustrated in FIG. 10, the step motor drive circuit 60 comprises four transistors $Tr_1$, $Tr_2$, $Tr_3$ and $Tr_4$, and the winding start terminals $S_1$ and $S_2$ and the winding end terminals $E_1$ and $E_2$ are connected to the collectors of the transistors $Tr_1$, $Tr_2$, $Tr_3$ and $Tr_4$, respectively. In addition, the intermediate taps $M_1$ and $M_2$ are grounded via a power source 94. The collectors of the transistors $Tr_1$, $Tr_2$, $Tr_3$ and $Tr_4$ are connected to the power source 94 via corresponding diodes $D_1$, $D_2$, $D_3$ and $D_4$ for absorbing a surge current and via a resistor R, and the emitters of the transistors $Tr_1$, $Tr_2$, $Tr_3$ and $Tr_4$ are grounded. In addition, the bases of the transistors $Tr_1$, $Tr_2$, $Tr_3$ and $Tr_4$ are connected to the corresponding output terminals of the latch 90.

Figure 12:
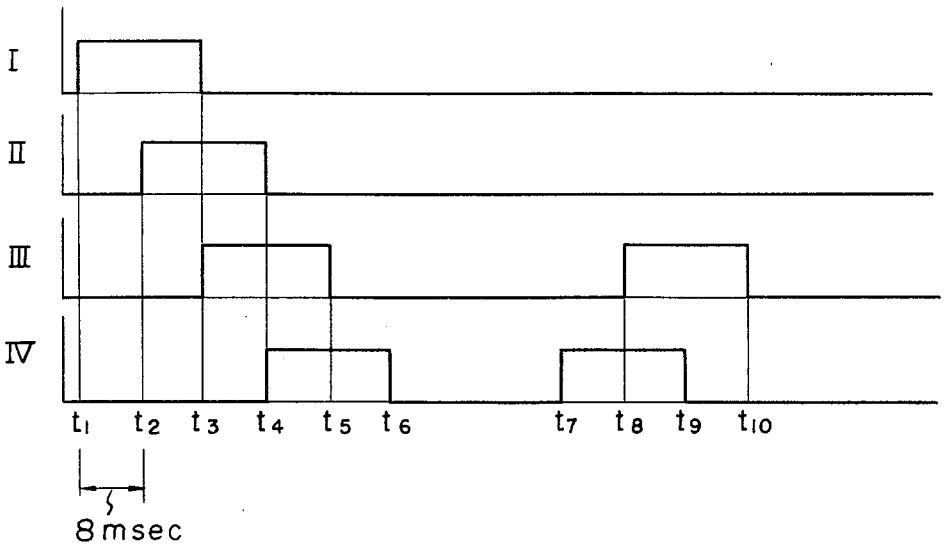
FIG. 12 is a time chart of control pulses of a stepper motor.

As mentioned above, in the MPU 80, the engine speed is calculated on the basis of the output pulses of the engine speed sensor 64. On the other hand, a function, representing a desired relationship between, for example, the temperature of the cooling water of the engine and the engine speed, is stored in the ROM 82 in the form of a formula or a data table. In the MPU 80, the rotating direction of the stepper motor 9, which is necessary to equalize the engine speed to a predetermined engine speed, is determined from the above-mentioned function and the engine speed at which the engine is now driven and, in addition, stepper motor drive data, which is necessary to rotate the stepper motor 9 in a stepping manner in the above-mentioned rotating direction, is obtained. Then, the stepper motor drive data is written in the output port 84. This writing operation of the stepper motor drive data is executed, for example, every 8 msec, and the stepper motor drive data, written in the output port 84, is retained in the latch 90 for 8 msec. For example, four bits of drive data "1000" are input to the output port 84 from the MPU 80 and, if the output terminals of the latch 90, which are connected to the transistors $Tr_1$, $Tr_2$, $Tr_3$ and $Tr_4$, are indicated by I, II, III and IV, respectively, the output signals "1", "0", "0" and "0" are produced at the output terminals I, II, III and IV of the latch 90, respectively, for 8 msec. FIG. 12 illustrates output signals produced at the output terminals I, II, III, IV of the latch 90. From FIG. 12, it will be understood that, during the time period from the time $t_1$ to the time $t_2$, the output signals "1", "0", "0" and "0" are produced at the output terminals I, II, III and IV of the latch 90, respectively. When the output signal, produced at the output terminal I of the latch 90, becomes "1", since the transistor $Tr_1$ is turned to the ON condition, the first phase exciting coil I is excited. Then, at the time $t_2$ in FIG. 12, if it is determined in the MPU 80 that the step motor 9 should be moved by one step in the direction wherein the valve head 36 (FIG. 2) opens, the step motor drive data "1100" is written in the output port 84. As a result of this, as illustrated in FIG. 12, during the time period from the time $t_2$ to the time $t_3$, the output signals "1", "1", "0 " and "0" are produced at the output terminals I, II, III and IV of the latch 90, respectively. Consequently, at this time, the transistor $Tr_2$ is also turned to the ON condition and, thus, the second phase exciting coil II is excited. As in the same manner as described above, during the time period from the time $t_3$ to the time $t_4$ in FIG. 12, since the output signals "0", "1", "1" and "0" are produced at the output terminals I, II, III and IV of the latch 90, respectively, the second phase exciting coil II and the third phase exciting coil III are excited and, during the time period from the time $t_4$ to the time $t_5$ in FIG. 12, since the output signals "0", "0", "1" and "1" are produced at the output terminals I, II, III and IV of the latch 90, respectively, the third phase exciting coil III and the fourth phase exciting coil IV are excited. From FIG. 12, it will be understood that the time duration necessary for the production of the output signals produced at the output terminals I, II, III, IV of the latch 90, that is, the length of time necessary to produce the exciting pulses applied to the exciting coils I, II, III, IV is the same, and that each length of time necessary to produce the exciting pulses applied to the adjacent two phase exciting coils overlaps by one half, as is shown in FIG. 12. An exciting system, in which the time periods of production of the exciting pulses applied to the adjacent two phase exciting coils are overlapped by one half, is called a two-phase exciting system.

Figure 13:
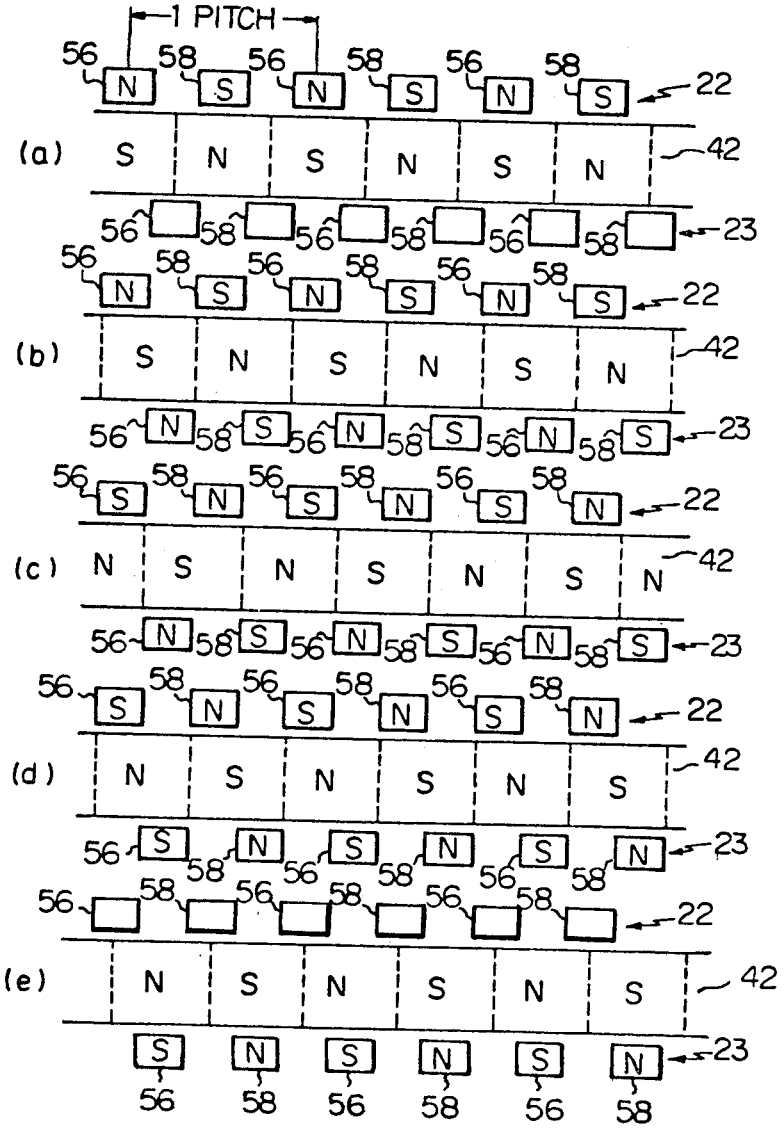
FIG. 13 is a schematically illustrative view of the stator and the rotor of a stepper motor.

FIG. 13 illustrates a schematic developed view of the outer circumferential surface of the hollow cylindrical outer body 42 of the rotor 21 and the pole pieces 56, 58 of the stators 22, 23. FIG. 13(*a*) illustrates the case wherein only the first phase exciting coil I is excited, as illustrated in FIG. 12, between the time $t_1$ and the time $t_2$. At this time, the polarity of the pole pieces 56 of the stator 22 is N, and the polarity of the pole pieces 58 of the stator 22 is S. Contrary to this, the polarity does not appear on the pole pieces 56, 58 of the stator 23. Consequently, at this time, the rotor 21 remains stopped at a position wherein each of the pole pieces 56 of the stator 22 faces the corresponding S pole of the hollow cylindrical outer body 42, and each of the pole pieces 58 of the stator 22 faces the corresponding N pole of the hollow cylindrical outer body 42. When the second phase exciting coil II is excited, as illustrated between the time $t_2$ and the time $t_3$ in FIG. 12, since the flow direction of the current in the secondary phase exciting coil II is the same as that of the current in the first phase exciting coil I, the polarity of the pole pieces 56 of the stator 23 becomes N, and the polarity of the pole pieces 58 of the stator 23 becomes S, as illustrated in FIG. 13(*b*). Consequently, at this time, the hollow cylindrical outer body 42 moves to a position wherein each of the S poles of the hollow cylindrical outer body 42 is located between the corresponding pole pieces 56 of the stator 22 and the corresponding pole pieces 56 of the stator 23, and each of the N poles of the hollow cylindrical outer body 42 is located between the corresponding pole pieces 58 of the stator 22 and the corresponding pole pieces 58 of the stator 23. Therefore, assuming that the distance between the adjacent two pole pieces 56 of the stator 22 is one pitch, as mentioned previously, the hollow cylindrical outer body 42 moves by a $\frac{1}{8}$ pitch towards the right in FIG. 13 from a position illustrated in FIG. 13(*a*) to a position illustrated in FIG. 13(*b*).

After this, when the third phase exciting coil III is excited, as illustrated between the time $t_3$ and the time $t_4$ in FIG. 12, since the flow direction of the current in the third phase exciting coil III is opposite to that of the current in the first phase exciting coil I, the polarity of the pole pieces 56 of the stator 22 becomes S, and the polarity of the pole pieces 58 of the stator 22 becomes N, as illustrated in FIG. 13(*c*). As a result of this, the hollow cylindrical outer body 42 moves by a $\frac{1}{4}$ pitch towards the right in FIG. 13, from a position illustrated in FIG. 13(*b*) to a position illustrated in FIG. 13(*c*). In the same manner as described above, when the fourth phase exciting coil IV is excited, as illustrated between the time $t_4$ and the time $t_5$ in FIG. 12, the hollow cylindrical outer body 42 moves by a $\frac{1}{4}$ pitch towards the right in FIG. 13, from a position illustrated in FIG. 13(*c*) to a position illustrated in FIG. 13(*d*). After this, during the time period from the time $t_5$ to the time $t_6$, only the fourth phase exciting coil IV is excited and, thus, the polarity does not appear on the pole pieces 56, 58 of the stator 22 as illustrated in FIG. 13(*e*). Consequently, at this time, the hollow cylindrical outer body 42 moves by a $\frac{1}{8}$ pitch towards the right in FIG. 13 from a position illustrated in FIG. 13(*d*) to a position illustrated in FIG. 13(*e*), so that each of the pole pieces 56 of the stator 23 faces the corresponding N pole of the hollow cylindrical outer body 42, and each of the pole pieces 58 of the stator 23 faces the corresponding S pole of the hollow cylindrical outer body 42. Then, at the time $t_6$ in FIG. 12, the stepper motor drive data "0000" is written in the output port 84 and, thus, since all the output signals, produced at the output terminals I, II, III, IV of the latch 90, become "0", the exciting operation of all the exciting coils I, II, III, IV is stopped. At this time, as illustrated in FIG. 13(*e*), each of the pole pieces 56 of the stator 23 faces the corresponding N pole of the hollow cylindrical outer body 42, and each of the pole pieces 58 of the stator 23 faces the corresponding S pole of the hollow cylindrical outer body 42. Consequently, the hollow cylindrical outer body 42 is stationarily retained at a position illustrated in FIG. 13(*e*) due to the attracting forces of the N pole and the S pole of the hollow cylindrical outer body 42, which forces act on the pole pieces 56 and the pole pieces 58 of the stator 23, respectively. In addition, exciting data, indicating that the fourth phase exciting coil IV is excited before the hollow cylindrical outer body 42 is stationarily retained, as mentioned above, is stored in a predetermined address in the RAM 81.

At the time $t_7$ in FIG. 12, in the case wherein it is determined in the MPU 80 that the stepper motor 9 should be moved by one step in the direction wherein the valve head 36 (FIG. 2) opens, exciting data, indicating the phase of the exciting coil which was lastly excited, is read out from the RAM 81 and, if the phase of the exciting coil, which was lastly excited, is the fourth phase, the stepper motor drive data "0001" is initially written in the output port 84. Consequently, only the fourth phase exciting coil IV is excited, as illustrated between the time $t_7$ and the time $t_8$ in FIG. 12. At this time, since the hollow cylindrical outer body 42 is located in a position illustrated in FIG. 13(*e*), the hollow cylindrical outer body 42 remains stationary. After this, when the third phase exciting coil III is excited as illustrated, between the time $t_8$ and the time $t_9$, the polarities, as illustrated in FIG. 13(*d*), appear on the pole pieces 56, 58 of the stators 22, 23 and, thus, the hollow cylindrical outer body 42 moves by $\frac{1}{8}$ towards the left in FIG. 13 from a position illustrated in FIG. 13(*e*) to a position illustrated in FIG. 13(*d*).

As illustrated between the time $t_1$ and the time $t_6$ in FIG. 12, when the exciting coils I, II, III, IV are successively excited from the first phase exciting coil I to the fourth phase exciting coil IV, the hollow cylindrical outer body 42 of the rotor 21 moves relative to the stators 22, 23 and, acccordingly, the rotor 21 rotates in one direction. When the rotor 21 rotates, since the external screw threads 29 of the valve shaft 20 are in engagement with the internal screw threads 47 of the hollow cylindrical inner body 40, as illustrated in FIG. 2, the valve shaft 20 is caused to move in one direction, for example, towards the left in FIG. 2. As a result of this, since the cross-sectional area of the annular air flow passage 38 formed between the valve head 36 and the valve seat 19 is increased, in FIG. 1, the amount of air fed via the bypass pipe 16 into the surge tank 2 from the intake duct 3 located upstream of the throttle valve 4 is increased. Contrary to this, during the time period between the time $t_7$ and the time $t_{10}$, since the valve shaft 20 is caused to move towards the right in FIG. 2, the cross-sectional area of the annular air flow passage 38 formed between the valve head 36 and the valve seat 19 is reduced.

Figures 15, 15A, 15B:
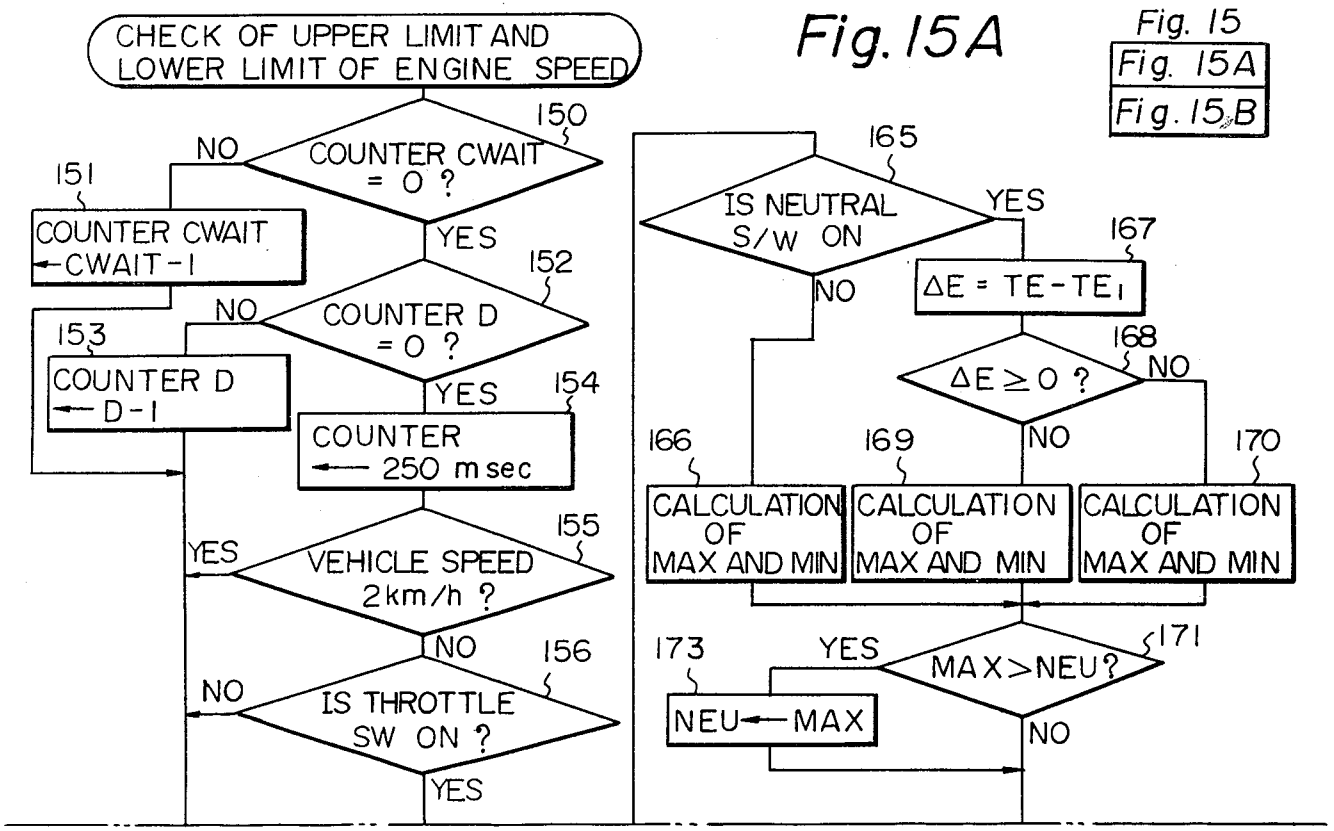
FIG. 15 is a flow chart illustrating the check processing of the upper limit and the lower limit in FIG. 14.
Figure 15B:
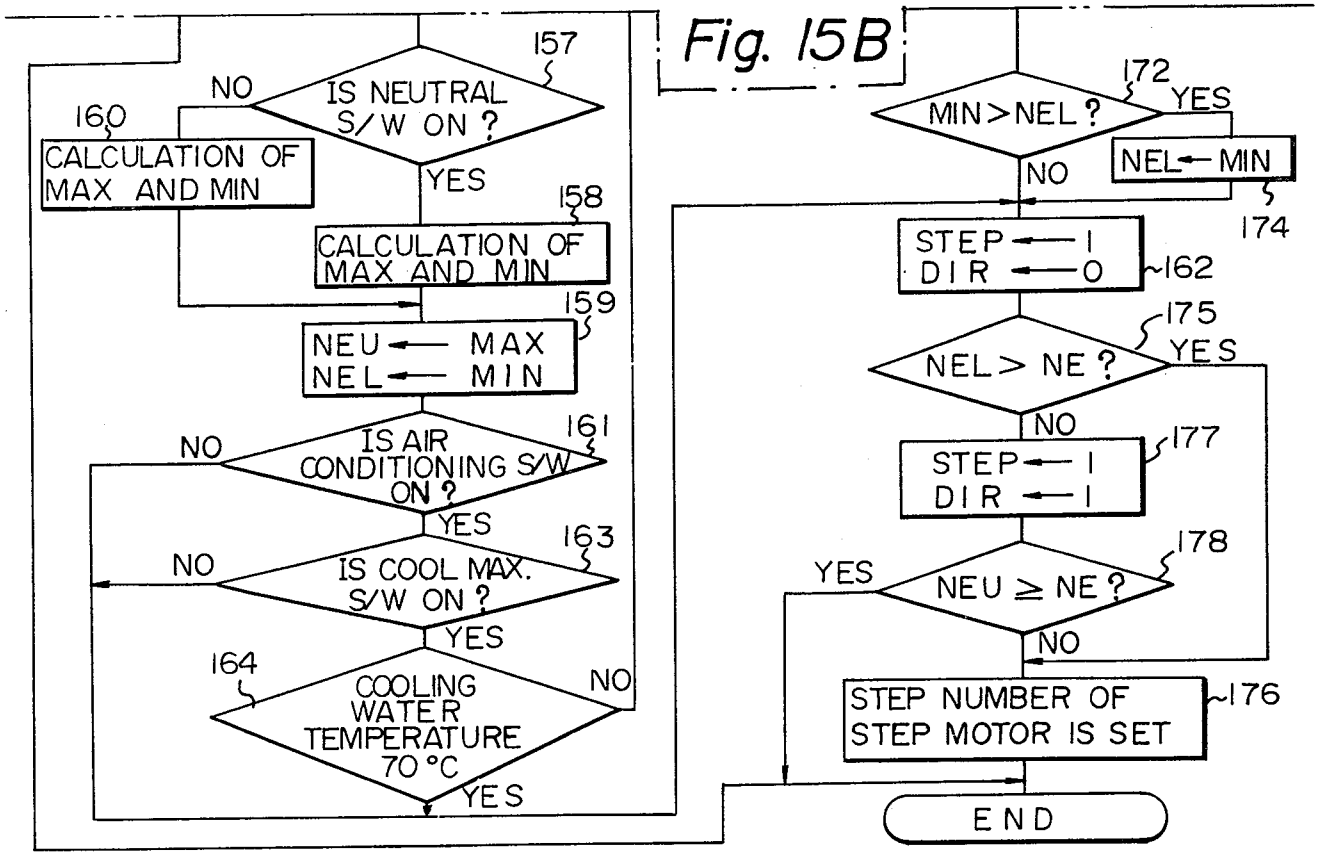
Figure 16:
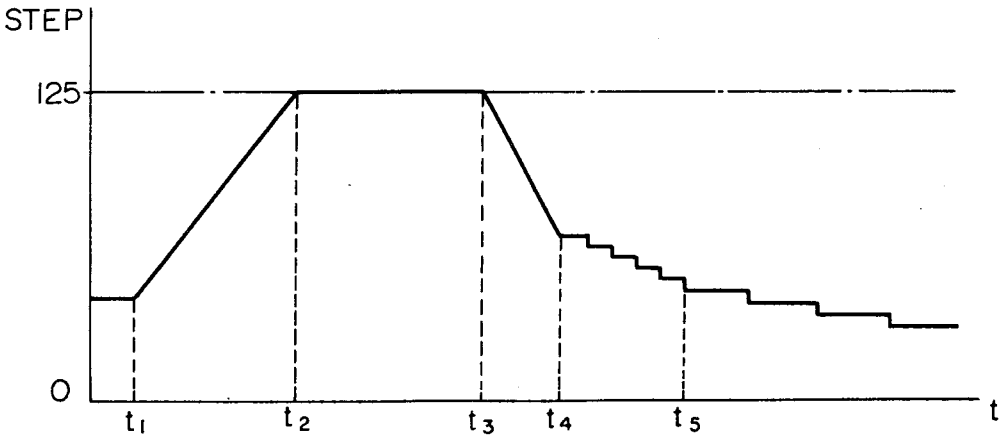
FIG. 16 is a time chart illustrating a change in the step position of a stepper motor.

FIGS. 14 and 15 illustrate flow charts of the operation which are executed when the amount of air flowing within the bypass pipe 16 is controlled, and FIG. 16 illustrates the general behavior of the stepper motor 9. In FIG. 16, the ordinate STEP indicates a step position of the step motor 9, and the abscissa t indicates time. In addition, in FIG. 16, 0 of the ordinate STEP indicates that the valve head 36 (FIG. 2) is in the fully closed position, that is, in the extreme right side of FIG. 2, and 125 of the ordinate STEP indicates that the valve head 36 is in the fully opened position, that is, in the extreme left side of FIG. 2. In FIG. 14, step 100 means that the routine is processed by sequential interruptions which are executed periodically at predetermined times. This interruption in executed, for example, every 8 msec.

Firstly, in step 101, the operation of the ignition switch 91 is input into the MPU 80 via the input port 83, and it is determined whether the ignition switch 91 is in the ON position. If it is determined in step 101 that the ignition switch 91 is not in the ON position, the initializing processing of the step motor 9 is executed in step 102. In this initializing processing, the difference between the present step position STEP stored in the RAM 81, and the step position 125, wherein the valve head 36 (FIG. 2) is fully opened, is calculated. Then, in step 103, the stepper motor 9 is rotated by a step number corresponding to the above-mentioned difference in the direction wherein the valve head 36 is opened. In addition, in the stepper motor initializing processing in step 102, during the time the stepper motor drive processing is executed in step 103, current continues to be fed into the coil 95 of the relay 92 and, thereby, the switch 93 of the relay 92 is maintained in the ON position. When the stepper motor drive processing in step 103 is completed, the feeding of current into the coil 95 of the relay 92 is stopped and, thus, the switch 93 is turned to the ON position. Consequently, even if the ignition switch 91 is turned to the OFF position, power is supplied to the electronic control unit 61 via the switch 93 of the relay 92 until the stepper motor 9 is rotated to a position wherein the valve head 36 is fully opened. In FIG. 16, the time $t_1$ indicates the moment when the ignition switch 91 is turned to the OFF condition, and the time $t_2$ indicates the moment when the switch 93 of the relay 92 is turned to the OFF position. Consequently, from FIG. 16, it will be understood that, during the time period from the time $t_1$ to the time $t_2$, the stepper motor 9 is rotated to a step position 125 wherein the valve head 36 (FIG. 2) is fully opened.

Figure 17:
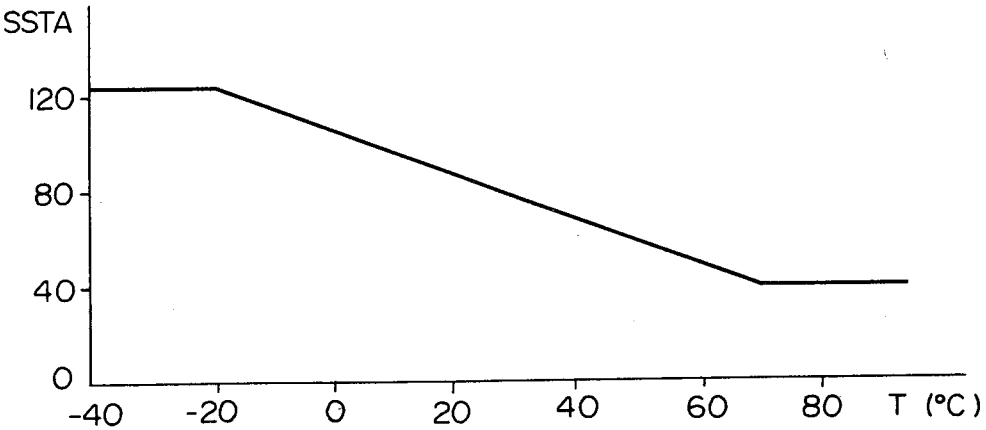
FIG. 17 is a diagram illustrating the relationship between the starting step position of a stepper motor and the temperature of the cooling water of an engine.

If the ignition switch 91 is turned to the ON position a little while after the ignition switch 91 is turned to the OFF position, power is supplied to the electronic control unit 61. At this time, since it is determined in step 101 in FIG. 14 that the ignition switch 91 is in the ON position, it is determined in step 104 whether the ignition flag has been set. At this time, since the ignition flag has not been set, the routine goes to step 105, and the ignition flag is set. After this, the start control executing flag is set in step 106 and, then, in step 107, the starting step position SSTA is calculated on the basis of the output signal of the cooling water temperature sensor 63. FIG. 17 illustrates the relationship between the starting step position SSTA and the temperature T(° C.) of the cooling water of the engine. As will be understood from FIG. 17, the starting step position SSTA is equal to 125 when the temperature of the cooling water of the engine is lower than −20° C.; the starting step position SSTA is reduced as the temperature of the cooling water of the engine is increased from −20° C. to 70° C.; the starting step position SSTA becomes equal to 40 when the temperature of the cooling water of the engine is increased beyond 70° C. The relationship between the starting step position SSTA and the temperature of the cooling water of the engine, which is illustrated in FIG. 17, is stored in the ROM 82 in the form of a function or a data table and, in step 107, the starting step position SSTA is calculated from the above-mentioned function or data table. Then, in step 108, the present step position is subtracted from the starting step position SSTA, and the result of the subtraction is input into the step number STEP. Then, in step 109, it is determined whether the step number STEP is negative and, if it is determined in step 109 that the step number STEP is not negative, "0" is put into the stepper motor rotating direction DIR in step 110. After this, in stepper 111, the step motor rotating direction DIR and the step number STEP to be moved are stored in a predetermined address in the RAM 81. In FIG. 14, DIR=0 indicates the stepper motor rotating direction wherein the valve head 36 (FIG. 2) is moved towards the opened position, and DIR=1 indicates the stepper motor rotating direction wherein the valve head 36 is moved towards the closed position. On the other hand, if it is determined in step 109 that the step number STEP is negative, the absolute value of the step number STEP is put into the step number STEP in step 112. After this, in step 113, "1" is put into the stepper motor rotating direction DIR and, then, in stepper 111, the step motor rotating direction DIR and the step number STEP to be moved are stored in a predetermined address in the RAM 81. Then, in step 103, the stepper motor rotating direction DIR and the step number STEP to be moved are read out from the RAM 81 and written in the output port 84, and, as a result, the stepper motor 9 begins to rotate by the step number STEP in the stepper motor rotating direction DIR.

In the next processing cycle, in step 104, it is again determined whether the ignition flag has been set. At this time, if the ignition flag has been set in step 105 in the preceding processing cycle, it is determined in step 115 whether the start control executing flag is set. If the start control executing flag has been set in step 106 in the preceding processing cycle, since it is determined in step 115 that the start control executing flag has been set, it is determined in step 116 whether the stepper motor 9 is now rotating towards the starting step position SSTA. If it is determined in step 116 that the stepper motor 9 is now rotating towards the starting step position SSTA, the rotating operation of the stepper motor 9 is caused to continue in step 103. In FIG. 16, the time $t_3$ indicates the moment when the stepper motor 9 begins to rotate towards the starting step position SSTA, and the time $t_4$ indicates that the stepper motor 9 reaches the starting step position SSTA. Consequently, during the time period from the time $t_3$ to the time $t_4$ in FIG. 16, since it is determined in step 116 in FIG. 14 that the stepper motor 9 is now rotating towards the starting step position SSTA, the stepper motor drive processing is executed in step 103. At this time, the exciting coils I, II, III, IV of the stepper motor 9 are successively excited every 8 msec, as illustrated in FIG. 12. On the other hand, if the time reaches the time $t_4$ in FIG. 16, since the rotating operation of the stepper motor 9 is stopped, it is determined in step 116 that the stepper motor 9 is not now rotating. At this time, in step 117, the start control executing flag is reset and, then, in step 118, the counter C is set by 3 sec. As mentioned above, since the interruptions are executed every 8 msec in the routine illustrated in FIG. 14, the operation of setting the counter C by 3 sec means that numeral 375 (=3 sec/8 msec) is put into the counter C. After this, the counter D is set by 250 msec in step 119 and, then, in step 120, the counter CWAIT is set by 10 sec. Then, in step 121, it is determined whether the temperature of the cooling water of the engine is lower than 20° C. and, if it is determined in step 121 that the temperature of the cooling water of the engine is lower than 20° C., the routine jumps to step 122. Contrary to this, if it is determined in step 121 that the temperature of the cooling water of the engine is not lower than 20° C., the counter CWAIT is set by 3 sec in step 123 and, then, the routine goes to step 124. In step 124, it is determined whether the temperature of the cooling water of the engine is higher than 70° C. If it is determined in step 124 that the temperature of the cooling water of the engine is higher than 70° C., the counter CWAIT is set by 0.5 sec in step 125 and, then, the routine goes to step 122. Contrary to this, if it is determined in step 124 that the temperature of the cooling water of the engine is not higher than 70° C., the routine jumps to step 122. In step 122, it is determined whether the content of the counter C is equal to zero. However, at this time, since the counter C has been set by 3 sec in step 118, it is determined in step 122 that the content of the counter C is not equal to zero and, thus, the routine jumps to step 126. In step 126, "C−1" is put into "C", that is, the content of the counter C is decremented by one. After this, in step 127, the check processing of the upper limit and the lower limit of the engine speed, which will be hereinafter described in detail, is executed and, then, in step 128, the feedback control is executed. In step 128, the engine speed is so controlled that it becomes equal to a desired engine speed when the temperature of the cooling water of the engine is higher than 70° C. Then, the routine goes to step 103.

In the next processing cycle, since the start control executing flag has been reset, it is determined in step 115 that the start control executing flag has not been set and, thus, the routine goes to step 122. When 3 sec has elapsed after the step position of the stepper motor 9 reaches the starting step position SSTA, the content of the counter C becomes equal to zero. Consequently, when 3 sec has elapsed after the step position of the stepper motor 9 reaches the starting step position, it is determined in step 122 that the content of the counter C is equal to zero and, thus, the routine goes to step 130. In step 130, the counter C is set again by 3 sec and, then, the routine goes to step 131.

Figure 18:
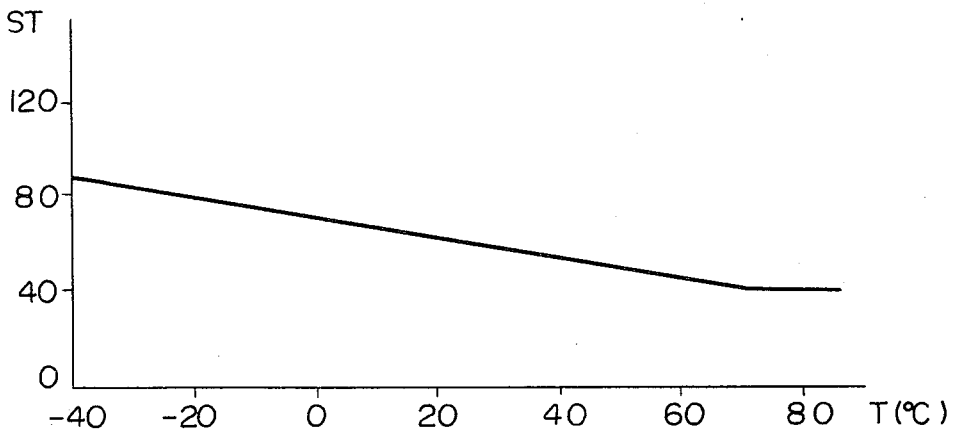
FIG. 18 is a diagram illustrating the relationship between the warm-up step positions of a stepper motor and the temperature of the cooling water of an engine.

In step 131, "1" is put into the step number STEP of the stepper motor 9, and "0" is put into the stepper motor rotating direction DIR. As mentioned previously, DIR=0 indicates the rotating direction wherein the valve head 36 (FIG. 2) is moved to open, and DIR=1 indicates the rotating direction wherein the valve head 36 is moved to close. Then, in step 132, it is determined whether the warm-up step position ST is larger than the starting step position SSTA illustrated in FIG. 17. As illustrated in FIG. 18, the warm-up step position ST is changed in accordance with a change in the temperature T(° C.) of the cooling water of the engine, and the relationship between the warm-up step position ST and the temperature T(° C.) of the cooling water of the engine has been stored in the ROM 82. Consequently, in step 132, it is determined whether the warm-up step position, calculated from the above-mentioned relationship and the temperature T(° C.) of the cooling water of the engine, is larger than the starting step position SSTA. If it is determined in step 132 that the warm-up step position ST is larger than the starting step position SSTA, "SSTA+1" is input into SSTA in step 133. Consequently, at this time, SSTA no longer indicates the starting step position illustrated in FIG. 17, but indicates the step position determined by the warm-up control. Then, in step 134, the step number "1" of the stepper motor 9 and the stepper motor rotating direction DIR=0 are stored in a predetermined address in the RAM 81. On the other hand, if it is determined in step 132 that the warm-up step position ST is not larger than the step position SSTA, it is determined in step 135 whether the warm-up step position ST is equal to the step position SSTA. If it is determined in step 135 that the warm-up step position ST is not equal to the step position SSTA, "SSTA−1" is put into the stepper position SSTA in step 136, and "1" is also put into the step motor rotating direction DIR. Then, in step 134, the step number "1" of the stepper motor 9 and the stepper motor rotating direction DIR=1 are stored in a predetermined address in the RAM 81. Then, in stepper 103, the stepper motor 9 is rotated by the step number stored in the RAM 81 in the rotating direction stored in the RAM 81. On the other hand, if it is determined in step 135 that the warm-up step position ST is equal to the step position SSTA, the stepper motor drive processing is executed in step 103. However, at this time, actually, the stepper motor 9 remains stationary. Consequently, when the step position SSTA becomes equal to the warm-up step position ST, the stepper motor 9 remains stopped. As mentioned above, the time $t_4$ in FIG. 16 indicates the moment when the step position of the stepper motor 9 reaches the starting step position SSTA and, at this time, the warm-up control is started. If the warm-up control is started, the stepper motor 9 is rotated by one step every 3 sec and, when the step position of the stepper motor 9 reaches the warm-up step position ST, the stepper motor 9 is stopped. This time is indicated by $t_5$ in FIG. 16. After the time $t_5$, when the temperature T (FIG. 18) of the cooling water of the engine is increased and, thus, the warm-up step position ST is changed, the stepper motor 9 is rotated by one step. As mentioned above, when the temperature of the cooling water of the engine becomes higher than 70° C., the feedback control is started.

The check processing of the upper limit and the lower limit of the engine speed, which is illustrated in step 127 in FIG. 14, will be hereinafter described with reference to FIG. 15. Referring to FIG. 15, at first, in step 150, it is determined whether the content of the counter CWAIT is equal to zero. Since the counter CWAIT has been set by 10 sec, 3 sec and 0.5 sec in steps 120, 123 and 125, respectively, in FIG. 14, when the routine initially goes to step 150, the content of the counter CWAIT is not equal to zero. Consequently, at this time, the routine goes to step 151, and the content of the counter CWAIT is decremented by one. Then, the processing cycle is completed. Consequently, if the counter CWAIT has been set by, for example, 10 sec, when 10 sec has elapsed after the routine initially goes to step 151, the content of the counter CWAIT becomes equal to zero. Consequently, at this time, it is determined in step 150 that the content of the counter CWAIT is equal to zero and, thus, the routine goes to step 152. In step 152, it is determined whether the content of the counter D is equal to zero. Since the counter D has been set by 250 msec in step 119 in FIG. 14, when the routine initially goes to step 152, the content of the counter D is not equal to zero. Consequently, at this time, the routine goes to step 153, and the content of the counter D is decremented by one. Then, the processing cycle is completed. When 250 msec has elapsed after the routine initially goes to step 153, the content of the counter D becomes equal to zero. Consequently, at this time, in step 152, it is determined that the content of the counter D is equal to zero and, thus, the routine goes to step 154. In step 154, the counter D is set again by 250 msec. Consequently, it will be understood that, when 10 sec or 3 sec or 0.5 sec has elapsed after the routine goes to step 152, then, the routine goes to step 154 every 250 msec. After the counter D has been set by 250 msec in step 154, the routine goes to step 155, and it is determined whether the vehicle speed is higher than 2 km/h on the basis of the output signal of the vehicle speed sensor 62. If it is determined in step 155 that the vehicle speed is higher than 2 km/h, the processing cycle is completed and, if it is determined in step 155 that the vehicle speed is not higher than 2 km/h, the routine goes to step 156. In step 156, it is determined whether the throttle switch 65 is in the ON position, that is, whether the throttle valve 4 is fully closed. If it is determined in step 156 that the throttle switch 65 is not in the ON position, the processing cycle is completed and, if it is determined in step 156 that the throttle switch 65 is in the ON position, the routine goes to step 157. Consequently, it will be understood that, when the vehicle speed is not higher than 2 km/h, and the throttle switch 65 is in the ON position, that is, when the engine is operating under an idling condition, the routine goes to step 157. In step 157, it is determined whether the neutral switch 66 is in the ON position on the basis of the output signal of the neutral switch 66. If it is determined in step 157 that the neutral switch 66 is in the ON position, the upper limit MAX and the lower limit MIN of the engine are calculated in step 158 and, then, the routine goes to step 159. On the other hand, if it is determined in step 157 that the neutral switch 66 is not in the ON position, that is, when the automatic transmission is in the drive range D, the upper limit MAX and the lower limit MIN of the engine speed are calculated in step 160 and, then, the routine goes to step 159.

Figure 19:
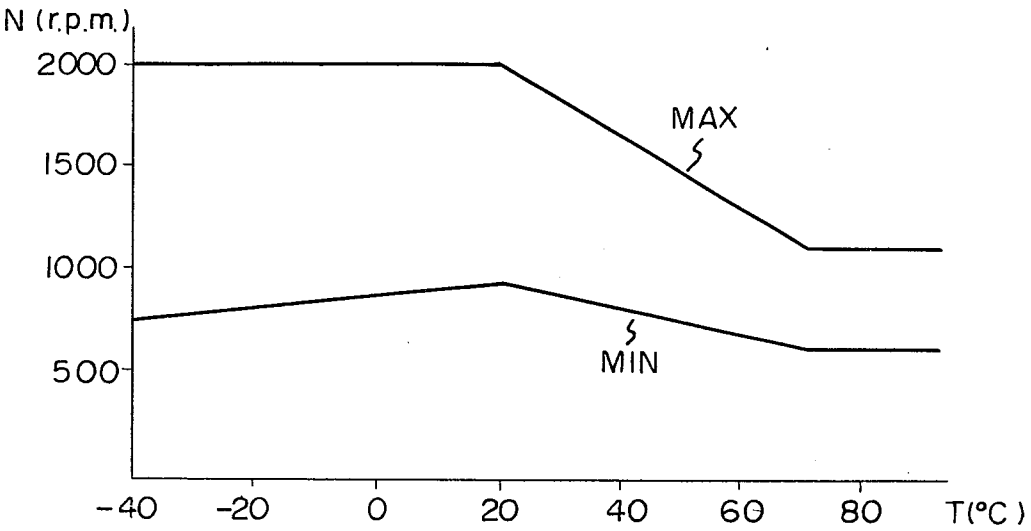
FIG. 19 is a diagram illustrating the upper limit and the lower limit of the engine speed in the case wherein the transmission is in the neutral range.
Figure 20:
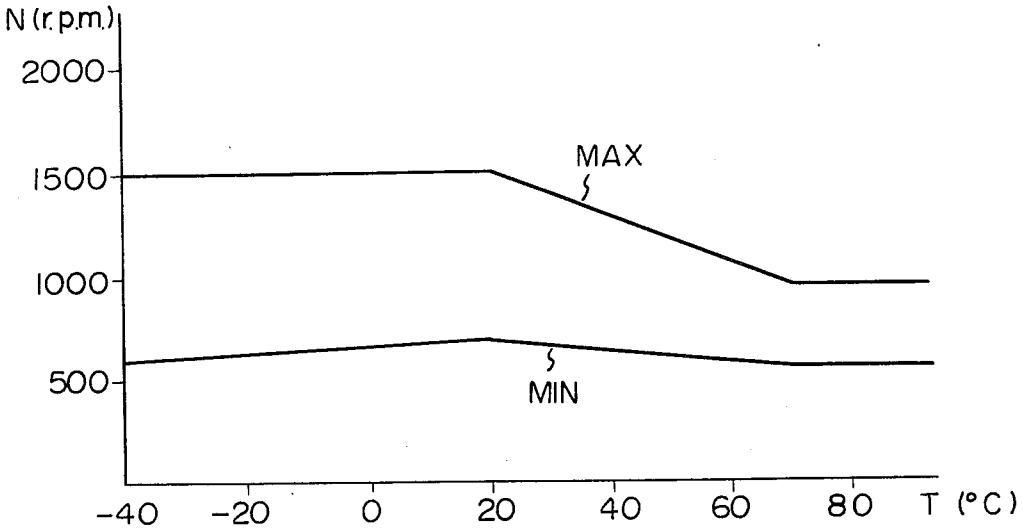
FIG. 20 is a diagram illustrating the upper limit and the lower limit of the engine speed in the case wherein the transmission is in the drive range.

FIG. 19 illustrates the upper limit MAX and the lower limit MIN of the engine speed when the automatic transmission is in the neutral range N, and FIG. 20 illustrates the upper limit MAX and the lower limit MIN of the engine speed when the automatic transmission is in the drive range D. In the case wherein the automatic transmission is in the neutral range N, as illustrated in FIG. 19, when the temperature T of the cooling water of the engine is lower than 20° C., the upper limit MAX is approximately equal to 2000 r.p.m.; when the temperature T becomes higher than 20° C., the upper limit MAX is decreased as the temperature T is increased, and; when the temperature T becomes higher than 70° C., the upper limit MAX becomes equal to a fixed value of about 1250 r.p.m. In addition, as illustrated in FIG. 19, the lower limit MIN is gently changed within the range of about 600 r.p.m. through 900 r.p.m. and, when the temperature T becomes higher than 70° C., the lower limit MIN becomes equal to a fixed value of about 600 r.p.m. Contrary to this, in the case wherein the automatic transmission is in the drive range D, as illustrated in FIG. 20, when the temperature T of the cooling water of the engine is lower than 20° C., the upper limit MAX is approximately equal to 1500 r.p.m.; when the temperature T becomes higher than 20° C., the upper limit MAX is decreased as the temperature T is increased when the temperature T becomes higher than 70° C., the upper limit MAX becomes equal to a fixed value of about 950 r.p.m. In addition, as illustrated in FIG. 20, the lower limit MIN is gently changed within the range of about 550 r.p.m. through 700 r.p.m. and, when the temperature T becomes higher than 70° C., the lower limit MIN becomes equal to a fixed value of about 500 r.p.m. The relationship between the temperature T of the cooling water of the engine and the upper and lower limits MAX, MIN of the engine speed N has been stored in the ROM 82 in the form of a function or a data table. Consequently, in step 158 in FIG. 15, the upper limit MAX and the lower limit MIN are calculated from the relationship illustrated in FIG. 19 and, in step 160 in FIG. 15, the upper limit MAX and the lower limit MIN are calculated from the relationship illustrated in FIG. 20. In step 159 in FIG. 15, the upper limit MAX is put into the upper limit NEU, and the lower limit MIN is put into the lower limit NEL. Then, in step 161, it is determined whether the air conditioning switch 73 is in the ON position. If it is determined in step 161 that the air conditioning switch 73 is not in the ON position on the basis of the output signal of the air conditioning switch 73, the routine jumps to step 162 and, if it is determined in step 161 that the air conditioning switch 73 is in the ON position, the routine goes to step 163. In step 163, it is determined whether the cool max. switch 75 is in the ON position. If it is determined in step 163 that the cool max. switch 75 is not in the ON position, the routine jumps to step 162, and, if it is determined in step 163 that the cool max. switch 75 is in the ON position, the routine goes to step 164. In step 164, it is determined whether the temperature of the cooling water of the engine is higher than 70° C. on the basis of the cooling water temperature sensor 63. If it is determined in step 164 that the temperature of the cooling water of the engine is higher than 70° C., the routine goes to step 162 and, if it is determined in step 164 that the temperature of the cooling water of the engine is not higher than 70° C., the routine goes to step 165. In step 165, it is determined whether the neutral switch 66 is in the ON position. If it is determined in step 165 that the neutral switch 66 is not in the ON position, the upper limit MAX and the lower limit MIN of the engine speed are calculated in step 166. On the other hand, if it is determined in step 165 that the neutral switch 66 is in the ON position, the routine goes to step 167. In step 167, the temperature $TE_1$ of air, which has been detected by the temperature sensor 76 arranged at the outlet of the evaporator 223 (FIG. 11) in the preceding processing cycle and is stored in the RAM 81, is subtracted from the temperature TE of air, which has been detected by the temperature sensor 76 in the present processing cycle, and the result of the subtraction is put into ΔE. Then, in step 168, it is determined whether ΔE is not negative. If it is determined in step 168 that ΔE is not negative, the upper limit MAX and the lower limit MIN of the engine speed are calculated in step 169. On the other hand, if it is determined in step 168 that E is negative, the upper limit MAX and the lower limit MIN of the engine speed are calculated in step 170.

Figure 21:
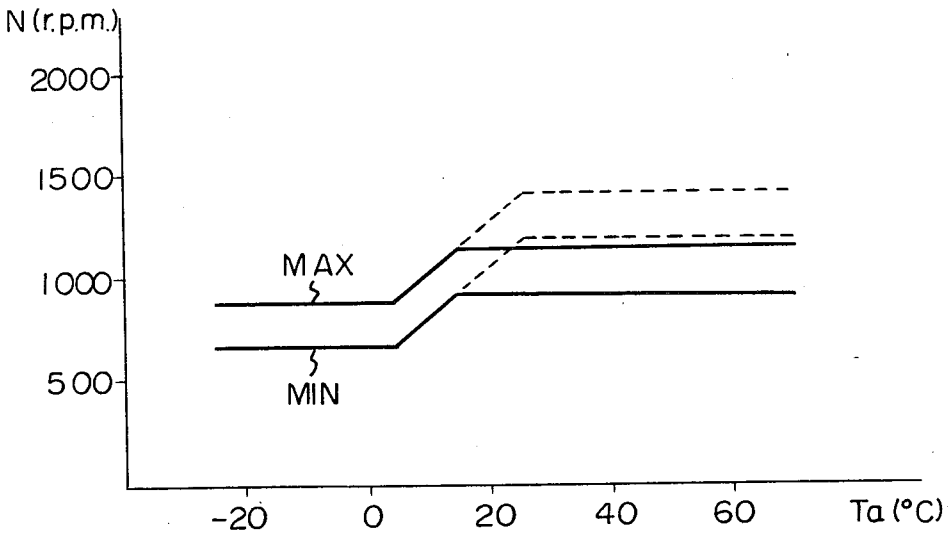
FIG. 21 is a diagram illustrating the upper limit and the lower limit of the vehicle speed when the cool max. switch is turned to the ON position in the case wherein the transmission is in the neutral range.
Figure 22:
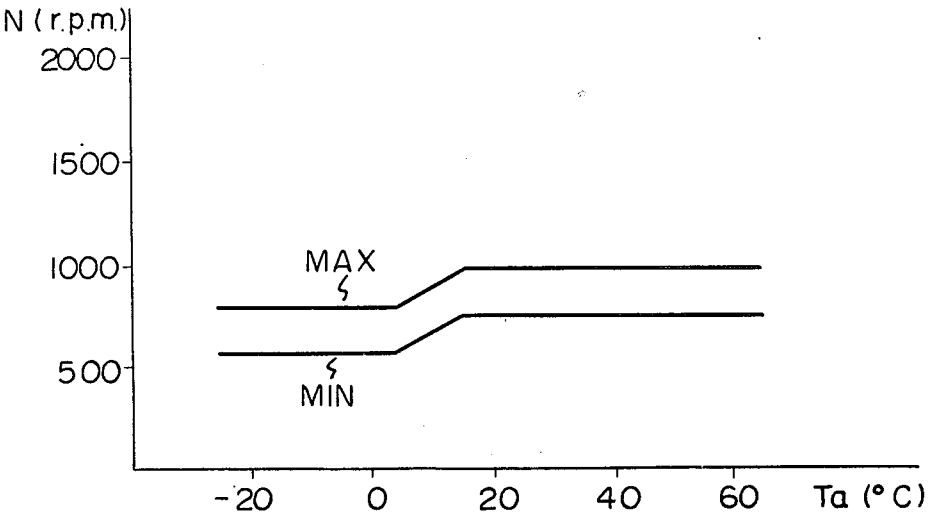
FIG. 22 is a diagram illustrating the upper limit and the lower limit of the vehicle speed when the cool max. switch is turned to the ON position in the case wherein the transmission is in the drive range.

FIG. 21 illustrates the upper limit MAX and the lower limit MIN of the engine speed in the case wherein the automatic transmission is in the neutral range N, and FIG. 22 illustrates the upper limit MAX and the lower limit MIN of the engine speed in the case wherein the automatic transmission is in the drive range D. In FIGS. 21 and 22, the ordinate indicates the engine speed N (r.p.m.), and the abscissa indicates the temperature Ta(° C.) of air, which is detected by the temperature sensor 76 arranged at the outlet of the evaporator 223. In FIG. 21, the upper limit MAX, illustrated by the solid line, is equal to a fixed value of about 850 r.p.m. when the temperature Ta is lower than about 5° C., and this upper limit MAX is equal to a fixed value of about 1100 r.p.m. when the temperature Ta is higher than about 15° C. In addition, the upper limit MAX, illustrated by the broken line in FIG. 21, is equal to a fixed value of about 1350 r.p.m. when the temperature Ta is higher than about 25° C. Contrary to this, in FIG. 21, the lower limit MIN is lower than the upper limit MAX by about 200 r.p.m. On the other hand, in FIG. 22, the upper limit MAX is equal to about 800 r.p.m. when the temperature Ta is lower than about 5° C., and the upper limit MAX is equal to a fixed value of about 950° C. when the temperature Ta is higher than about 15° C. Contrary to this, in FIG. 22, the lower limit MIN is lower than the upper limit MAX by about 200 r.p.m. The relationship between the temperature Ta and the upper limit MAX, illustrated in FIGS. 21 and 22, and the relationship between the temperature Ta and the lower limit MIN, illustrated in FIGS. 21 and 22, are stored in the ROM 82 in the form of a function or a data table.

As mentioned above, FIG. 22 illustrates the upper limit MAX and the lower limit MIN in the case wherein the automatic transmission is in the drive range D. Consequently, in step 166, the upper limit MAX and the lower limit MIN of the engine speed are calculated from the relationship illustrated in FIG. 22. On the other hand, the upper limit MAX and the lower limit MIN, illustrated by the solid line in FIG. 21, indicate the upper limit MAX and the lower limit MIN, respectively, in the case wherein the temperature Ta is increasing. Therefore, in step 169, the upper limit MAX and the lower limit MIN are calculated from the relationship illustrated by the solid line in FIG. 21. In addition, the upper limit MAX and the lower limit MIN, illustrated by the broken line in FIG. 21, indicate the upper limit MAX and the lower limit MIN, respectively, in the case wherein the temperature Ta is decreasing. Therefore, in step 170, the upper limit MAX and the lower limit MIN are calculated from the relationship illustrated by the broken line in FIG. 21. When the calculation of the upper limit MAX and the lower limit MIN is completed in step 166 or 169 or 170, the routine goes to step 171. In step 171, it is determined whether the upper limit MAX is higher than the upper limit NEU which has been obtained in step 159. If it is determined in step 171 that the upper limit MAX is not higher than the upper limit NEU, the routine goes to step 172. Contrary to this, if it is determined in step 171 that the upper limit MAX is higher than the upper limit NEU, the upper limit MAX is put into the upper limit NEU in step 173, and, then, the routine goes to step 172. In step 172, it is determined whether the lower limit MIN is higher than the lower limit NEL which has been obtained in step 159. If it is determined in step 172 that the lower limit MIN is not higher than the lower limit NEL, the routine goes to step 162. Contrary to this, if it is determined in step 172 that the lower limit MIN is higher than the lower limit NEL, the lower limit MIN is put into the lower limit NEL in step 174 and, then, the routine goes to step 162.

In step 162, "1" is put into the step number STEP of the stepper motor 9 and "0" is put into the rotating direction DIR of the stepper motor 9. As mentioned previously, DIR=0 indicates the stepper motor rotating direction wherein the valve head 36 (FIG. 2) is moved towards the fully opened position, and DIR=1 indicates the stepper motor rotating direction wherein the valve head 36 is moved towards the closed position. Then, in step 175, it is determined whether the engine speed NE, at which the engine is now driven, is lower than the lower limit NEL. If it is determined in step 175 that the engine speed NE is lower than the lower limit NEL, the routine goes to step 176, and the step number STEP=1 and the stepper motor rotating direction DIR=0 are stored in a predetermined address in the RAM 81. On the other hand, if it is determined in step 175 that the engine speed NE is not lower than the lower limit NEL, the routine goes to step 177. In step 177, "1" is put into the step number STEP of the stepper motor 9, and "1" is put into the rotating direction DIR of the stepper motor 9. Then, in step 178, it is determined whether the engine speed NE is lower than the upper limit NEU. If it is determined in step 178 that the engine speed NE is lower than the upper limit NEU, the processing cycle is completed. Contrary to this, if it is determined in step 178 that the engine speed NE is not lower than the upper limit NEU, the routine goes to step 176. In step 176, the step number STEP=1 and the stepper motor rotating direction DIR=1 are stored in a predetermined address in the RAM 81. Then, the routine goes to step 128 (FIG. 14), and the feedback control is executed. Then, in step 103 (FIG. 14), the stepper motor 9 is rotated in the rotating direction stored in the RAM 81 by the step number stored in the RAM 81. As mentioned above, since the routine goes to step 154 every 250 msec, when the engine speed NE is higher or lower than the upper limit MEU or the lower limit MEL, respectively, the stepper motor 9 is rotated by one step every 250 msec.

According to the present invention, since the idling speed of the engine is restricted by the upper limit and the lower limit over the entire idling operating condition of the engine, even if the RAM malfunctions, there is no danger that the idling speed of the engine becomes too high or too low. As a result of this, it is possible to prevent the amount of harmful components in the exhaust gas from increasing and it is also possible to prevent the fuel consumption from increasing. In addition, in the present invention, when a predetermined time period has elapsed after the start control of the engine is completed, that is, after the time $t_4$ in FIG. 16, the check processing of the upper limit and the lower limit of the engine speed is started, and this predetermined time period is determined by the time period by which the counter CWAIT is set. As will be understood from FIG. 14, the above-mentioned predetermined time period becomes long as the temperature of the cooling water of the engine becomes low. This is because the length of time, necessary to stabilize the idling speed of the engine after the start control of the engine is completed, becomes long as the temperature of the cooling water of the engine becomes low. Furthermore, as illustrated in FIGS. 19 and 20, the difference between the upper limit MAX and the lower limit MIN becomes small as the temperature of the cooling water of the engine becomes high. This is because, when the temperature T of the cooling water of the engine becomes high, the idling speed of the engine becomes stable and, in addition, the amount of air fed from the bypass pipe becomes small. In addition, in the case wherein the temperature of ambient air is high when the operation of the air conditioning device is started for cooling the driver's compartment, since it is necessary to cool air flowing within the air duct of the air conditioning device to the maximum, the cool max. switch is turned to the ON position. In this case, the idling speed of the engine is increased in response to the output signal of the cool max. switch for increasing the rotating speed of the compressor for cooling. If the cooling operation of the driver's compartment is started, the temperature Ta of air (FIGS. 21 and 22) is gradually decreased. Since the idling speed of the engine is increased when the cool max. switch is turned to the ON position as mentioned above, in the present invention, as illustrated by the broken line in FIG. 21, the upper limit and the lower limit of the engine speed are increased in the case wherein the temperature Ta is decreasing, as compared with the case wherein the temperature Tb is increasing.

While the invention has been described by reference to a specific embodiment chosen for purposes of illustration, it should be apparent that numerous modifications could be made thereto by those skilled in the art without departing from the basic concept and scope of the invention.

We claim:

1. A method of controlling the idling speed of an engine having a main intake passage, a throttle valve arranged in the main intake passage, a bypass passage branched off from the main intake passage upstream of the throttle valve and connected to the main intake passage downstream of the throttle valve, a control valve arranged in the bypass passage, and a stepper motor actuating the control valve for controlling the amount of air flowing within the bypass passage, wherein said method comprises the steps of:

comparing the idling speed to upper and lower predetermined limits of engine speed;

rotating the stepper motor in a direction wherein the flow area of the control valve is reduced when the idling speed of the engine is greater than said predetermined upper limit of the idling speed for decreasing the idling speed below said predetermined upper limit;

rotating the stepper motor in a direction wherein the flow area of the control valve is increased when the idling speed of the engine is less than said predetermined lower limit of the idling speed for increasing the idling speed above said predetermined lower limit;

detecting the condition of an automatic transmission;

selecting one set of said upper and lower limits when the automatic transmission is in a neutral range, and selecting a different set when the automatic transmission is in a drive range;

measuring the temperature of the coolant of the engine;

maintaining said upper limit and said lower limit constant when the temperature of the coolant of the engine is greater than a predetermined temperature; and decreasing the difference between said upper limit and said lower limit as the temperature of the coolant of the engine increases when the temperature of the coolant of the engine is less than said predetermined temperature.

2. An apparatus for controlling the idling speed of an engine having a main intake passage, a throttle valve arranged in the main intake passage, a bypass passage branched off from the intake passage upstream of the throttle valve and connected to the main intake passage downstream of the throttle valve, a control valve arranged in the bypass passage, and a stepper motor actuating the control valve for controlling the amount of air flowing within the bypass passage, wherein said apparatus comprises:

means for detecting the idling speed of an engine;

means for detecting the condition of an automatic transmission;

means for measuring the temperature of the coolant of the engine;

processing means for: (1) comparing the idling speed to upper and lower predetermined limits of engine speed, (2) selecting one set of said upper and lower limits when the automatic transmission is in a neutral range and selecting a different set when the automatic transmission is in a drive range, (3) maintaining said upper limit and said lower limit constant when the temperature of coolant of the engine is greater than a predetermined temperature, and (4) decreasing the difference between said upper limit and said lower limit as the temperature of the coolant of the engine increases when the temperature of the coolant of the engine is less than said predetermined temperature; and means for rotating the stepper motor in a direction wherein the flow area of the control valve is reduced when the idling speed of the engine is greater than said predetermined upper limit of the idling speed for decreasing the idling speed below said predetermined upper limit, and for rotating the stepper motor in a direction wherein the flow area of the control valve is increased when the idling speed of the engine is less than said predetermined lower limit of the idling speed for increasing the idling speed beyond said predetermined lower limit.

3. A method according to claim 1, including the steps of detecting when an ignition switch is turned to the ON position, rotating the stepper motor from an initial step position wherein the control valve is fully opened to a predetermined step position determined by the temperature of coolant of the engine independently of said upper limit and said lower limit and, waiting for a predetermined time to elapse before controlling the stepper motor so that the idling speed is within a range between said upper limit and said lower limit.

4. A method according to claim 3, including the step of increasing the predetermined waiting time as the temperature of the coolant of the engine decreases.

5. A method according to claim 1, wherein said upper limit and said lower limit used when the automatic transmission is in the neutral range are greater than those used when the automatic transmission is in the drive range.

6. A method according to claim 1, including the steps of detecting when an air conditioning device for cooling a driver's compartment is operated and when air fed into the driver's compartment from the air conditioning device is cooled to the maximum, and selecting an upper limit and lower limit which are different from those used when the air conditioning device is not operated or when air fed into the driver's compartment from the air conditioning device is not cooled to maximum.

7. A method according to claim 6, including the step of increasing said upper limit and said lower limit which are used when the air conditioning device is operated and air fed into the driver's compartment from the air conditioning device is cooled to the maximum when the temperature of air which has passed through an evaporator of the air conditionining device is greater than a predetermined temperature.

8. A method according to claim 7, including the step of further increasing said upper limit and said lower limit which are used when the air conditioning device is operated and air fed into the driver's compartment from the air conditioning device is cooled to the maximum when an automatic transmission is in a neutral range and when the temperature of air which has passed through the evaporator is decreasing.

9. An apparatus according to claim 2, including means for detecting when an ignition switch is turned to an ON position, and wherein the means for rotating the stepper motor rotates the stepper motor from an initial step position wherein the control valve is fully opened to a predetermined step position determined by the temperature of coolant of the engine independently of said upper limit and said lower limit, and including means for timing a predetermined waiting time such that after said predetermined waiting time has elapsed the stepper motor is controlled so that the idling speed is within a range between said upper limit and said lower limit.

10. An apparatus according to claim 9, wherein the processing means increases said waiting time as the temperature of the coolant of the engine becomes low.

11. An apparatus according to claim 2, wherein said upper limit and said lower limit used when the automatic transmission is in the neutral range are greater than those used when the automatic transmission is in the drive range.

12. An apparatus according to claim 1, including means for detecting when an air conditioning device for cooling a driver's compartment is operated and when air fed into the driver's compartment from the air conditioning device is cooled to the maximum, and wherein said processing means selects an upper and lower limit which are different from those used when the air conditioning device is not operated or when air fed into the driver's compartment from the air conditioning device is not cooled to maximum.

13. An apparatus according to claim 12, wherein said processing means increases said upper limit and said lower limit which are used when the air conditioning device is operated and air fed into the driver's compartment from the air conditioning device is cooled to the maximum when the temperature of air which has passed through an evaporator of the air conditioning device is greater than a predetermined temperature.

14. An apparatus according to claim 13, wherein said processing means further increases said upper limit and said lower limit which are used when the air conditioning device is operated and air fed into the driver's compartment from the air conditioning device is cooled to the maximum when an automatic transmission is in a neutral range and when the temperature of air which has passed through the evaporator is decreasing.

* * * * *